US011365603B2

(12) United States Patent
Al-Mousa et al.

(10) Patent No.: US 11,365,603 B2
(45) Date of Patent: Jun. 21, 2022

(54) AUTOMATED DOWNHOLE FLOW CONTROL VALVES AND SYSTEMS FOR CONTROLLING FLUID FLOW FROM LATERAL BRANCHES OF A WELLBORE

(71) Applicant: Saudi Arabian Oil Company, Dhahran (SA)

(72) Inventors: Ahmed A. Al-Mousa, Dhahran (SA); Ahmed Ghaffar, Dhahran (SA); Omar Al-Hamid, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 59 days.

(21) Appl. No.: 17/082,227

(22) Filed: Oct. 28, 2020

(65) Prior Publication Data

US 2022/0127929 A1 Apr. 28, 2022

(51) Int. Cl.
*E21B 34/06* (2006.01)
*E21B 41/00* (2006.01)

(52) U.S. Cl.
CPC ..... *E21B 34/066* (2013.01); *E21B 41/0085* (2013.01); *E21B 2200/03* (2020.05); *E21B 2200/06* (2020.05)

(58) Field of Classification Search
CPC .... E21B 34/066; E21B 34/06; E21B 2200/03; E21B 2200/06
See application file for complete search history.

(56) References Cited

U.S. PATENT DOCUMENTS 5,697,441 A 12/1997 Vercaemer et al.
6,543,532 B2 * 4/2003 Estep ..... E21B 21/103 166/66.4
8,469,107 B2 6/2013 O'Malley et al.
8,881,833 B2 11/2014 Radford et al.
(Continued)

FOREIGN PATENT DOCUMENTS

CA 2624368 A1 11/2008
CN 103785923 A 5/2014
(Continued)

OTHER PUBLICATIONS

International Search Report and Written Opinion dated Jan. 25, 2022 pertaining to International application No. PCT/US2021/054777 filed Oct. 13, 2021, 15 pages.

*Primary Examiner* — Brad Harcourt
(74) *Attorney, Agent, or Firm* — Dinsmore & Shohl, LLP

(57) ABSTRACT

Downhole flow control valves include a valve assembly, driven gear, drive gear, and motor. The valve assembly includes an outer sleeve and inner sleeve. The outer sleeve has openings and a fixed guide. The inner sleeve is disposed within the outer sleeve and includes an outer surface and an axially abutting surface defining a stair-stepped pathway. The fixed guide abuts against the axially abutting surface. The abutment of the fixed guide against the axially abutting surface of the inner sleeve causes the inner sleeve to translate axially between an open position and a closed position relative to the outer sleeve when rotated through operation of the motor, drive gear and driven gear. Systems
(Continued)

for controlling fluid flow from lateral branches of a multilateral wellbore include at least a plurality of the downhole flow control valves and a downhole electrical power source for generating electrical power to operate the motor.

20 Claims, 15 Drawing Sheets

(56) References Cited

U.S. PATENT DOCUMENTS

| | | | | |
|---|---|---|---|---|
| 2009/0044944 | A1 | 2/2009 | Murray et al. | |
| 2009/0101329 | A1 | 4/2009 | Clem et al. | |
| 2009/0159290 | A1* | 6/2009 | Lauderdale | E21B 34/10 166/319 |
| 2011/0186303 | A1* | 8/2011 | Scott | E21B 34/08 166/373 |
| 2018/0223625 | A1 | 8/2018 | Noel | |

FOREIGN PATENT DOCUMENTS

| | | | |
|---|---|---|---|
| GB | 2447542 | A | 9/2008 |
| WO | 0029710 | A2 | 5/2000 |
| WO | 2020018201 | A1 | 1/2020 |

* cited by examiner

AUTOMATED DOWNHOLE FLOW CONTROL VALVES AND SYSTEMS FOR CONTROLLING FLUID FLOW FROM LATERAL BRANCHES OF A WELLBORE

BACKGROUND

Field

The present disclosure relates to natural resource well drilling and hydrocarbon production from subterranean formations, in particular, to apparatus and systems for well completion of natural resource wells.

Technical Background

Production of hydrocarbons from a subterranean formation generally includes drilling at least one wellbore into the subterranean formation. The wellbore forms a pathway capable of permitting both fluids and apparatus to traverse between the surface and the subterranean formations. Besides defining the void volume of the wellbore, the wellbore wall also acts as the interface through which fluid can transition between the formations through which the wellbore traverses the interior of the well bore. Hydrocarbon producing wellbores extend the subsurface and intersect various subterranean formations where hydrocarbons are trapped. Well drilling techniques can include forming multilateral wells that include lateral branches or laterals that extend laterally outward from a central wellbore, which may be referred to as the "motherbore."

Each lateral branch generally extends into a different part of the subterranean formation. Each of these different parts of the subterranean formation may include fluids having different fluid properties, such as temperature, pressure, viscosity, density, or other property, which may depend on the composition of the fluids in the portion of the subterranean formation or on the nature of the subterranean formation itself, such as formation pressure, temperature, or permeability. Differences in fluid properties or flow rates between branches can necessitate controlling the production flow rate from one or more lateral branches relative to other lateral branches or relative to the central bore. Additionally, hydrocarbon production from a multi-lateral wellbore can be substantially reduced if any one of the lateral branches encounters an increased gas or water cut after producing for a certain period. This is the most common case especially when each lateral branch is targeting different reservoir layers. For this purpose, inflow control valves are typically installed in the wellbore at each lateral branch during completion of the wellbore to control the flow of fluids produced from each lateral branch and extend the production life of multilateral wells.

SUMMARY

Inflow control valves installed in multi-lateral wellbores during wellbore completion typically include hydraulic or electronic actuation devices that require hydraulic lines and control lines extending from each inflow control valve to the surface of the wellbore. However, these inflow control valves require frequent operator intervention to change the position of the inflow control valves as well as frequent platform visits for maintenance to trouble shoot inflow control valves to avoid plugging in hydraulic control lines.

Accordingly, there is an ongoing need for downhole flow control valves and systems, in particular, downhole flow control valves and systems comprising the downhole flow control valves that are fully automated so that they do not require constant attention and maintenance by personnel at the surface. The downhole flow control valves of the present disclosure include a valve assembly, a drive gear, a driven gear, and a motor. The valve assembly can include an outer sleeve having one or more openings and an inner sleeve disposed within the outer sleeve. The inner sleeve can include an axially abutting surface defining a stair-stepped pathway around at least part of the outer surface of the inner sleeve, and the outer sleeve can include a fixed guide coupled to the inner surface of the outer sleeve. Abutment of the fixed guide of the outer sleeve against the axially abutting surface of the inner sleeve can cause the inner sleeve to translate in an axial direction between an open position and a closed position relative to the outer sleeve when the inner sleeve is rotated through operation of the motor, drive gear, and driven gear. In the closed position, the inner sleeve may block the openings in the outer sleeve to prevent the flow of fluids through the openings. The motor may be an electric motor so that the downhole flow control valves do not require hydraulic lines extending from the surface downhole to the valve.

Also disclosed in the present disclosure are systems for controlling flow in one or more lateral branches of a multilateral wellbore. The systems may include the downhole flow control valves along with a downhole electrical power system and one or more sensors. The downhole electrical power system may include one or more turbines coupled to the downhole flow control valves and operable to generate electrical power when contracted by fluid flow sufficient to turn the turbine. The electrical power system may further include one or more batteries. The turbines, batteries, or both may be electrically coupled to the motor to supply the electrical power for operating the motor. The sensors and the motor may be capable of communicating wirelessly with a system controller disposed at the surface, such as communicating through vibrations, sound waves, or other signal transported through the wellbore casing. The system controller may receive fluid property information from the downhole sensors, determine a position of one or more of the downhole flow control valves, and send a control signal to the motor to transition one or more of the valves based on the determination. Thus, the system may operate automatically to control the flow from the various lateral branches without requiring input from personnel at the surface. Additionally, the downhole electrical power system and wireless communication between the system controller and the downhole sensors and motor may allow for automatic operation of the downhole flow control valves without extending electrical and control wiring from the surface downhole to the system.

According to a first aspect of the present disclosure, a downhole flow control valve comprises a valve assembly, a drive gear, a driven gear, and a motor. The valve assembly may include an outer sleeve and an inner sleeve. The outer sleeve of the valve assembly may include one or more openings, an inner surface, and a fixed guide coupled to the inner surface of the outer sleeve. The inner sleeve of the valve assembly may be disposed within the outer sleeve of the valve assembly and may have an inner surface and an outer surface. The inner surface of the inner sleeve and portions of the inner surface of the outer sleeve may define a fluid flow path extending axially through the downhole flow control valve. The outer surface of the inner sleeve of the valve assembly may comprise an axially abutting surface defining a stair-stepped pathway around at least a portion of the outer surface of the inner sleeve. The fixed guide of the outer sleeve may abut against the axially abutting surface of the outer surface of the inner sleeve. The motor may be operatively coupled to the drive gear to rotate the drive gear. The drive gear may be engaged with the driven gear, and the driven gear may be rigidly coupled to one end of the inner sleeve of the valve assembly such that rotation of the drive gear may rotate the driven gear and the inner sleeve relative to the outer sleeve. Abutment of the fixed guide of the outer sleeve against the axially abutting surface of the inner sleeve may cause the inner sleeve to translate in an axial direction between an open position and a closed position relative to the outer sleeve when the inner sleeve is rotated through operation of the motor, drive gear, and driven gear.

A second aspect of the present disclosure may include the first aspect, where rotation of the inner sleeve in a first rotational direction may cause translation of the inner sleeve axially into the closed position where the inner sleeve blocks the one or more openings in the outer sleeve.

A third aspect of the present disclosure may include either one of the first or second aspects, where rotation of the inner sleeve in a second rotational direction opposite the first rotational direction may cause translation of the inner sleeve axially into the open position in which the openings in the outer sleeve are in fluid communication with the fluid flow path defined by the inner surface of the inner sleeve.

A fourth aspect of the present disclosure may include either one of the first or second aspects, where further rotation of the inner sleeve in the first direction may cause further translation of the inner sleeve axially from the closed position back to the open position.

A fifth aspect of the present disclosure may include any one of the first through fourth aspects, where the outer surface of the inner sleeve may comprise at least one rail protruding radially outward from the outer surface, and the at least one rail may comprise the axially abutting surface.

A sixth aspect of the present disclosure may include any one of the first through fifth aspects, where, in the open position, the one or more openings in the outer sleeve may be in fluid communication with the fluid flow path defined by the inner surface of the inner sleeve and portions of the inner surface of the outer sleeve.

A seventh aspect of the present disclosure may include any one of the first through sixth aspects, where the fixed guide may comprise a roller coupled to the outer sleeve by a pin, and the roller may rotate about the pin relative to the outer sleeve.

An eighth aspect of the present disclosure may include any one of the first through seventh aspects, further comprising a manually operated sleeve disposed within the outer sleeve. The manually operated sleeve may comprise an inner surface defining at least a portion of the fluid flow path through the downhole control valve. The inner surface of the manually operated sleeve may comprise a profile shaped to receive a wireline key tool. Engagement of the wireline key tool with the profile of the inner surface of the manually operated sleeve may enable manual translation of the manually operated sleeve between an open position and a closed position. In the closed position, the manually operated sleeve may block the plurality of openings in the outer sleeve to prevent fluid flow through the plurality of openings.

A ninth aspect of the present disclosure may include any one of the first through eighth aspects, further comprising a turbine coupled to the outer sleeve and rotatable relative to the outer sleeve.

A tenth aspect of the present disclosure may include the ninth aspect, where the turbine may be electrically coupled to the motor, and the turbine may be operable to produce at least a portion of the electrical power for operating the motor through rotation of the turbine.

An eleventh aspect of the present disclosure may include any one of the first through tenth aspects, further comprising one or more batteries. The one or more batteries may be electrically coupled to the motor and may be operable to provide electrical power for operating the motor.

A twelfth aspect of the present disclosure may include the eleventh aspect, where the one or more batteries may be rechargeable batteries.

A thirteenth aspect of the present disclosure may include either one of the eleventh or twelfth aspects, where the one or more batteries may be electrically coupled to a turbine operable to generate electrical power to recharge the battery.

A fourteenth aspect of the present disclosure may include any one of the first through thirteenth aspects, further comprising an inner sleeve pressure equalization port and an outer sleeve pressure equalization port. The inner sleeve pressure equalization port may be disposed in the inner sleeve, the outer sleeve pressure equalization port may be disposed in the outer sleeve, and the inner pressure equalization port and the outer pressure equalization portion may cooperate to equalize the pressure between the inner sleeve and the outer sleeve during actuation of the downhole flow control valve.

A fifteenth aspect of the present disclosure may include any one of the first through fourteenth aspects, further comprising at least one sensor operable to measure one or more properties of a fluid in contact with the downhole flow control valve.

A sixteenth aspect of the present disclosure may include the fifteenth aspect, where the at least one sensor may comprise one or more of a production pressure sensor, a fluid density sensor, a viscosity sensor, a temperature sensor, or combinations of these.

According to a seventeenth aspect of the present disclosure, a system for controlling fluid flow in one or more lateral branches of a multilateral wellbore may include a plurality of downhole flow control valves, a plurality of packers, a motor, and an electrical power source. Each downhole flow control valve may include an outer sleeve, an inner sleeve, a driven gear, and a drive gear. The outer sleeve of each downhole flow control valve may comprise one or more openings and a fixed guide coupled to an inner surface of the outer sleeve. The inner sleeve may be disposed within the outer sleeve for each downhole flow control valve. The inner surfaces of the inner sleeve and the outer sleeve of each downhole flow control valve may define a fluid flow path extending axially through the downhole flow control valve. The outer surface of the inner sleeve of each downhole flow control valve may comprise an axially abutting surface defining a stair-stepped pathway on at least a portion of the outer surface of the inner sleeve. The fixed guide of the outer sleeve may abut against the axially abutting surface of the outer surface of the inner sleeve. The driven gear may be rigidly coupled to one end of the inner sleeve, and the drive gear may be engaged with the driven gear to rotate the driven gear and the inner sleeve relative to the outer sleeve. Abutment of the fixed guide of the outer sleeve against the axially abutting surface of the inner sleeve may cause the inner sleeve to translate in an axial direction between an open position and a closed position relative to the outer sleeve when the inner sleeve is rotated. One of the plurality of packers may be disposed between each of the plurality of downhole flow control valves. The motor may be operatively coupled to the drive gear of each downhole flow control valve and may be operable to rotate the drive gear of each downhole flow control valve to move the inner sleeve between the open position and the closed position. The electrical power source may be disposed downhole and may be electrically coupled to the motor to provide electrical power to the motor.

An eighteenth aspect of the present disclosure may include the seventeenth aspect, where the electrical power source may comprise one or more batteries.

A nineteenth aspect of the present disclosure may include the eighteenth aspect, where the one or more batteries may be rechargeable batteries.

A twentieth aspect of the present disclosure may include any one of the seventeenth through nineteenth aspects, where the electrical power source may comprise a plurality of turbines operable to produce electrical power through rotation of the turbine. Each of the plurality of turbines may be coupled to one of the plurality of downhole flow control valves and may be electrically coupled to the motor, a battery that is electrically coupled to the motor, or both.

A twenty-first aspect of the present disclosure may include the twentieth aspect, comprising an electrical line electrically coupling the plurality of turbines to each other and to the motor, the battery, or both.

A twenty-second aspect of the present disclosure may include any one of the seventeenth through twenty-first aspects, where the plurality of downhole flow control valves, the motor, and the electrical power source are electrically isolated from a surface of a wellbore when the plurality of downhole flow control valves are installed in the wellbore.

A twenty-third aspect of the present disclosure may include any one of the seventeenth through twenty-second aspects, where one or more of the plurality of downhole flow control valves may comprise at least one sensor operable to measure at least one property of a fluid contacting the downhole flow control valve.

A twenty-fourth aspect of the present disclosure may include the twenty-third aspect, where the at least one sensor may comprise one or more of a production pressure sensor, a fluid density sensor, a viscosity sensor, a temperature sensor, or combinations of these.

A twenty-fifth aspect of the present disclosure may include either one of the twenty-third or twenty-fourth aspects, where the at least one sensor may comprise at least one sensor network interface device operable to wirelessly transmit one or more property signals indicative of one or more properties of the fluid contacting the downhole flow control valve with a system controller disposed at a surface of a wellbore.

A twenty-sixth aspect of the present disclosure may include the twenty-fifth aspect, where the at least one sensor network interface device may be operable to transmit the one or more property signals wirelessly through a wellbore casing of the wellbore to the system controller.

A twenty-seventh aspect of the present disclosure may include any one of the seventeenth through twenty-sixth aspects, further comprising a motor controller comprising at least one motor processor, at least one motor memory module, and computer readable and executable instructions that, when executed by the at least one motor processor, may cause the motor controller to automatically receive one or more valve control signals from a system controller, where each of the one or more valve control signals may be indicative of a position of one or more of the plurality of downhole flow control valves, and operate the motor to transition one or more of the plurality of downhole flow control valves to the open position or the closed position based on the one or more valve control signals.

A twenty-eighth aspect of the present disclosure may include the twenty-seventh aspect, where the motor controller may comprise a motor network interface device operable to receive one or more wireless signals from the system controller disposed at a surface of a wellbore, the one or more wireless signals comprising the one or more valve control signals.

A twenty-ninth aspect of the present disclosure may include the twenty-eighth aspect, where the motor network interface device may be operable to receive the one or more wireless signals transmitted through a wellbore casing of the wellbore from the system controller.

A thirtieth aspect of the present disclosure may include any one of the seventeenth through twenty-ninth aspects, further comprising a system controller disposed at a surface of a wellbore in which the plurality of downhole flow control valves are installed. The system controller may comprise at least one system processor, at least one system memory module, and computer readable and executable instructions which, when executed by the at least one system processor, may cause the system controller to automatically receive at least one property signal from at least one sensor coupled to one of the plurality of downhole flow control valves, where the at least one property signal is indicative of at least one property of a fluid contacting the one of the plurality of downhole flow control valves, determine a position of the one of the plurality of downhole flow control valves based on the property signal, and transmit a valve control signal indicative of a position of the one of the plurality of downhole flow control valves to a motor controller operatively coupled to the motor.

A thirty-first aspect of the present disclosure may include the thirtieth aspect, where the system controller may comprise a system network interface device operable to transmit and receive wireless signals.

A thirty-second aspect of the present disclosure may include the thirty-first aspect, where the system network interface device may be operable to transmit and receive wireless signals propagated through a wellbore casing of the wellbore.

According to a thirty-third aspect of the present disclosure, a method for controlling flow from at least one lateral branch of a wellbore can include positioning at least one downhole flow control valve at an intersection of the at least one lateral branch and a central bore of the wellbore. The at least one downhole flow control valve may comprise a valve assembly, a drive gear, a driven gear, and a motor. The valve assembly may comprise an outer sleeve and an inner sleeve. The outer sleeve of the valve assembly may comprise one or more openings, an inner surface, and a fixed guide coupled to the inner surface of the outer sleeve. The inner sleeve of the valve assembly may be disposed within the outer sleeve of the valve assembly. The inner sleeve of the valve assembly may comprise an inner surface and an outer surface. The inner surface of the inner sleeve and the inner surface of the outer sleeve may define a fluid flow path extending axially through the downhole flow control valve. The outer surface of the inner sleeve of the valve assembly may comprise an axially abutting surface defining a stair-stepped pathway around at least a portion of the outer surface of the inner sleeve. The fixed guide of the outer sleeve may abut against the axially abutting surface of the outer surface of the inner sleeve. The motor may be operatively coupled to the drive gear to rotate the drive gear. The drive gear may be engaged with the driven gear and the driven gear may be rigidly coupled to one end of the inner sleeve of the valve assembly such that rotation of the drive gear may rotate the driven gear and the inner sleeve relative to the outer sleeve. The abutment of the fixed guide of the outer sleeve against the axially abutting surface of the inner sleeve may cause the inner sleeve to translate in an axial direction between an open position and a closed position relative to the outer sleeve when the inner sleeve is rotated through operation of the motor, drive gear, and driven gear. The method may further include determining whether to allow fluid flow from the at least one lateral branch and transitioning the at least one downhole flow control valve to the open position or the closed position based on the determination.

A thirty-fourth aspect of the present disclosure may include the thirty-third aspect, further comprising measuring at least one property of a fluid in the at least one lateral branch with at least one sensor coupled to the at least one downhole flow control valve, determining a position of the at least one downhole flow control valve based on the measured property, and transitioning the at least one downhole flow control valve to the open position or the closed position based on the determination.

A thirty-fifth aspect of the present disclosure may include the thirty-fourth aspect, where the measured property may be one or more of production pressure, fluid density, fluid viscosity, temperature, or combinations of these.

A thirty-sixth aspect of the present disclosure may include any one of the thirty-third through thirty-sixth aspects, where the wellbore may comprise a plurality of lateral branches and the method may further comprise: positioning a plurality of downhole flow control valves in the wellbore, where each of the plurality of downhole flow control valves is disposed at an intersection of the central bore with one of the plurality of lateral branches; measuring at least one property of a fluid in each of the plurality of lateral branches with one or more sensors coupled to each of the plurality of downhole flow control valves; determining a position of each of the plurality of downhole flow control valves based on the measured properties of the fluids in each of the plurality of lateral branches; and transitioning one or more of the plurality of downhole flow control valves to the open position or the closed position based on the determination.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Figure 3:
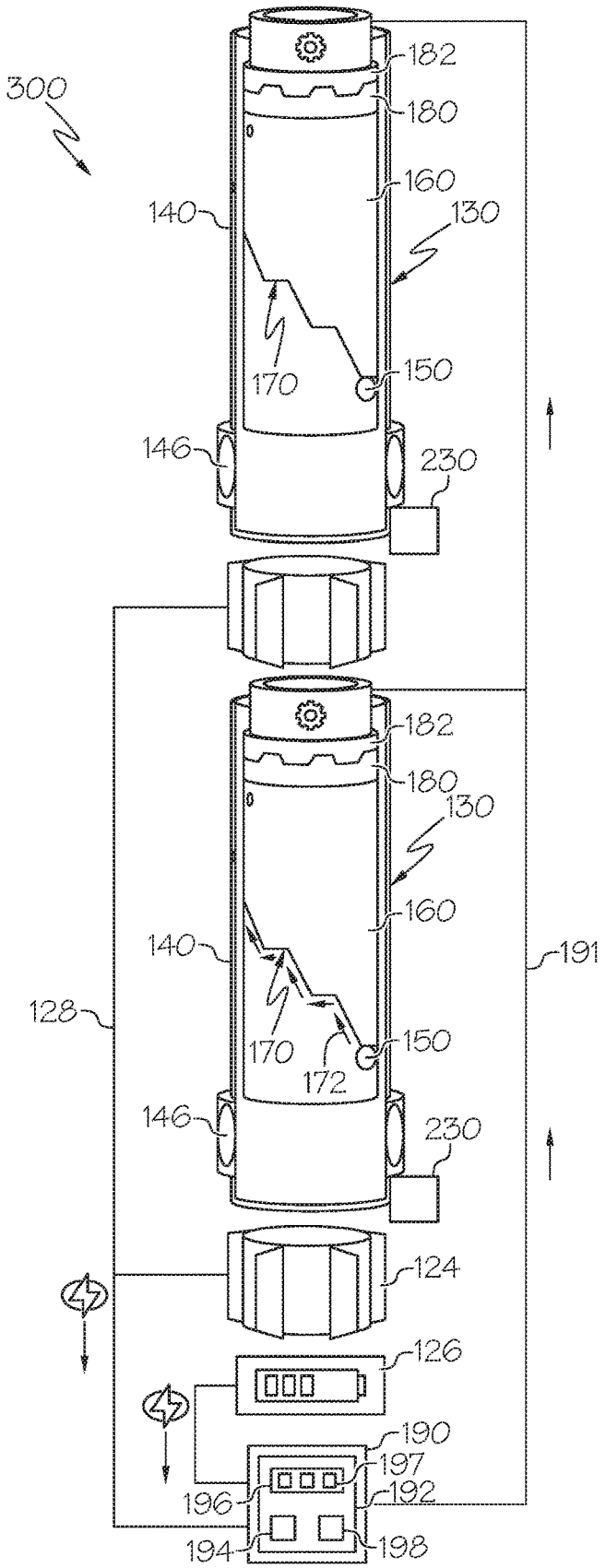
FIG. 3 schematically depicts an exploded view, in partial cross-section, of downhole flow control valves, turbines, motor, and electrical power system of the system of FIG. 2, according to one or more embodiments shown and described in this disclosure.

The present disclosure is directed to automated downhole flow control valves and systems for controlling flow from one or more lateral branches of a multilateral wellbore using the downhole flow control valves. Referring to FIG. 3, one embodiment of a downhole flow control valve 120 according to the present disclosure is schematically depicted. The downhole flow control valve 120 may include a valve assembly 130, a driven gear 180, a drive gear 182, and a motor 190. The valve assembly 130 may include an outer sleeve 140 and an inner sleeve 160. The outer sleeve 140 of the valve assembly 130 may define one or more openings 146, and may have an inner surface 144 and a fixed guide 150 coupled to the inner surface 144. The inner sleeve 160 of the valve assembly 130 may be disposed within the outer sleeve 140 and may include an outer surface 162 and an inner surface 164. The inner surface 164 of the inner sleeve 160 and the inner surface 144 of the outer sleeve 140 may define a fluid flow path 166 extending axially through the downhole flow control valve 120. The outer surface 162 of the inner sleeve 160 may include an axially abutting surface 170 defining a stair-stepped pathway 172 around at least a portion of the outer surface 162 of the inner sleeve 160. The fixed guide 150 of the outer sleeve 140 may abut against the axially abutting surface 170 of the inner sleeve 160. The motor 190 may be operatively coupled to the drive gear 182 to rotate the drive gear 182, and the drive gear 182 may be engaged with the driven gear 180. The driven gear 180 may be rigidly coupled to one end of the inner sleeve 160 of the valve assembly 130 such that rotation of the drive gear 182 rotates the driven gear 180 and the inner sleeve 160 relative to the outer sleeve 140. The abutment of the fixed guide 150 of the outer sleeve 140 against the axially abutting surface 170 of the inner sleeve 160 may cause the inner sleeve 160 to translate in an axial direction between an open position and a closed position relative to the outer sleeve 140 when the inner sleeve 160 is rotated through operation of the motor 190, drive gear 182, and driven gear 180.

Figure 1:
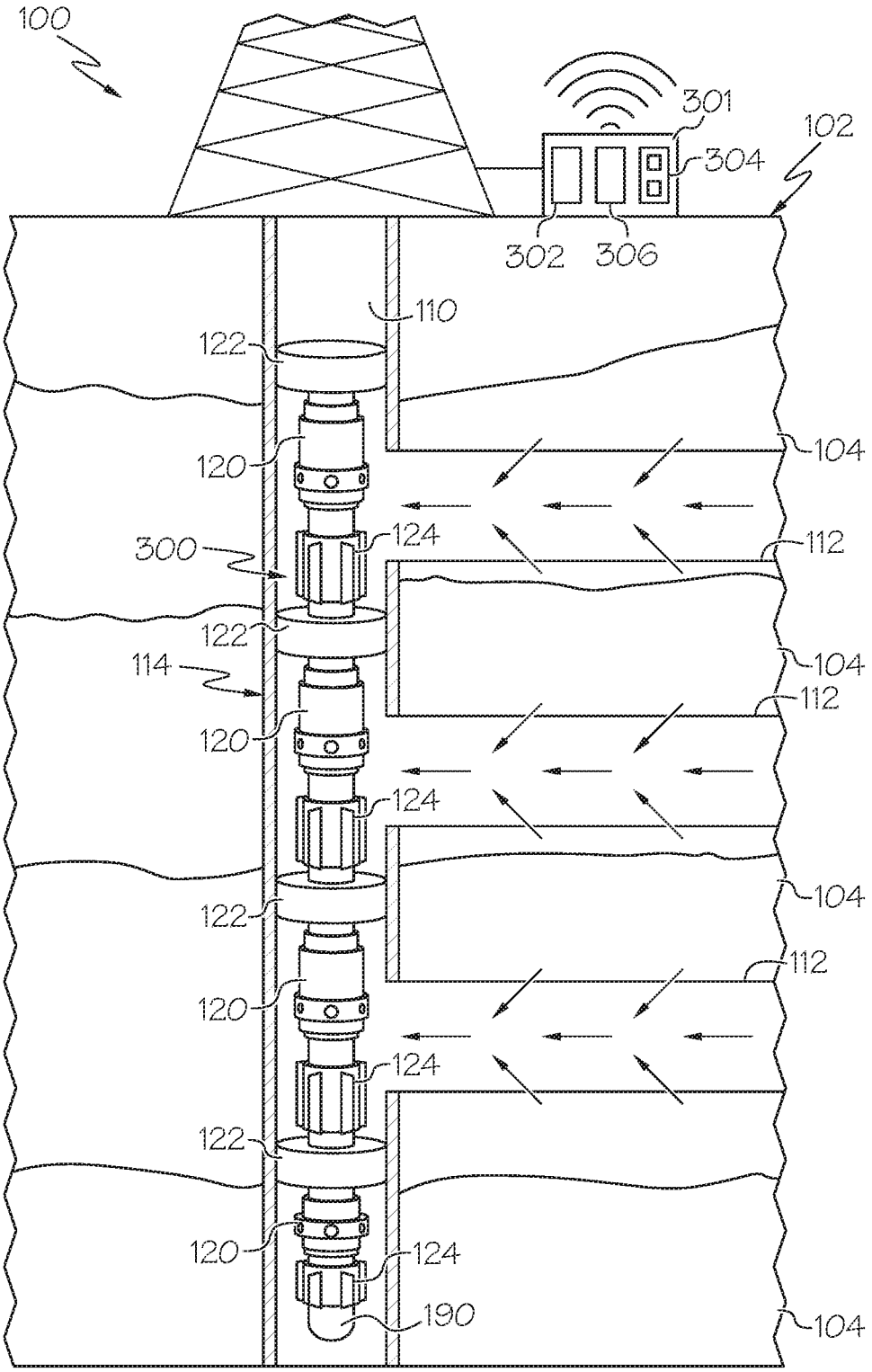
FIG. 1 schematically depicts a multilateral wellbore comprising a system for controlling fluid flow from one or more lateral branches of the multilateral wellbore, according to one or more embodiments shown and described in this disclosure.
Figure 2:
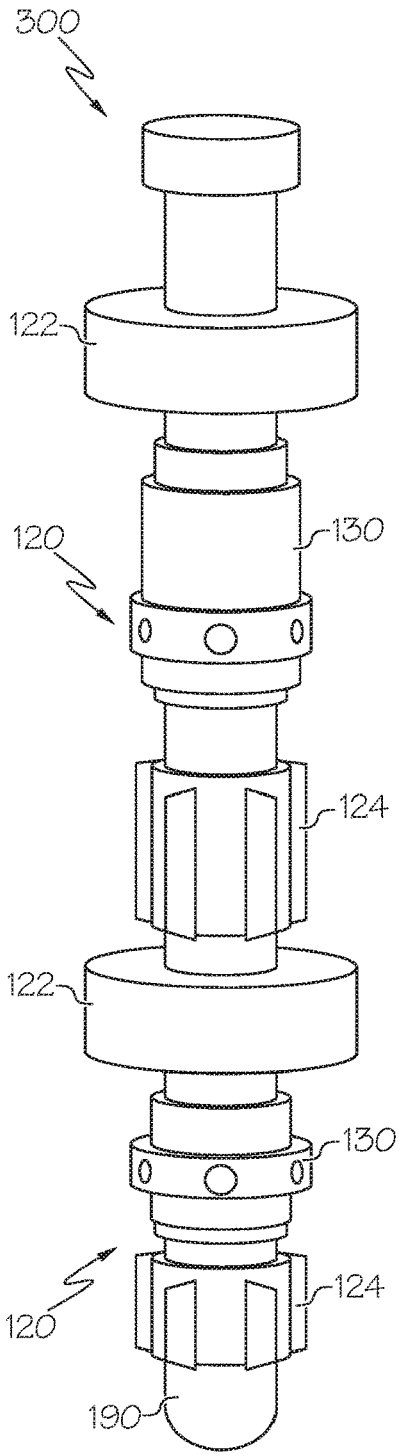
FIG. 2 schematically depicts the system depicted in FIG. 1 for controlling fluid flow from the lateral branches of the wellbore, according to one or more embodiments shown and described in this disclosure.

Referring to FIGS. 2 and 3, a system 300 for controlling fluid flow in one or more lateral branches 112 of a multilateral wellbore 100 according to the present disclosure is schematically depicted. The system 300 may include a plurality of the downhole flow control valves 120, a plurality of packers 22, the motor 190, and an electrical power source. Each of the downhole flow control valves 120 may include the outer sleeve 140, the inner sleeve 160, the driven gear 180, and the drive gear 182, as previously discussed. Referring to FIG. 1, one of the plurality of packers 122 may be disposed between each of the plurality of downhole flow control valves 120. This may fluidly isolate each of the downhole flow control valves 120 from each other when the system 300 is installed in the wellbore 100. Referring again to FIG. 3, the motor 190 may be operatively coupled to the drive gear 182 of each downhole flow control valve 120. The motor 190 may be operable to rotate the drive gear 182 of each downhole flow control valve 120 to move the inner sleeve 160 between the open position and the closed position. The electrical power source may be disposed downhole and may be electrically coupled to the motor 190 to provide electrical power to the motor 190. The electrical power source may include one or a plurality of turbines 124, one or more batteries 126, or both. Referring to FIG. 1, the system 300 may also include a system controller 301 disposed at the surface 102 of the wellbore and operable to wirelessly communicate with the motor 190, and one or more sensors 230 (FIG. 3) coupled to each of the downhole flow control valves 120 to automatically control actuation of the downhole flow control valves 120 based on fluid properties of fluids in each of the lateral branches 112.

The downhole flow control valves 120 and systems 300 that include the downhole flow control valves 120 of the present disclosure may operate automatically to control the flow from the various lateral branches 112 without requiring input from personnel at the surface 102. Additionally, the downhole electrical power system and wireless communication between the system controller and the downhole sensors and motor may allow for automatic operation of the downhole flow control valves without extending hydraulic lines or electrical and control wiring from the surface downhole to the system 300, among other benefits.

As used throughout the present disclosure, the term "hydrocarbon-bearing formation" refers to a subterranean geologic region containing hydrocarbons, such as crude oil, hydrocarbon gases, or both, which may be extracted from the subterranean geologic region. The terms "subterranean formation" or just "formation" may refer to a subterranean geologic region that contains hydrocarbons or a subterranean geologic region proximate to a hydrocarbon-bearing formation, such as a subterranean geologic region to be treated for purposes of enhanced oil recovery or reduction of water production.

As used throughout the present disclosure, the terms "motherbore" and "central bore" refer to the main trunk of a wellbore extending from the surface downward to at least one subterranean formation.

As used throughout the present disclosure, the term "lateral branch" refers to a secondary bore in fluid communication with the central bore or motherbore and extending from the central bore laterally into a subterranean formation. The central bore may connect each lateral branch to the surface.

As used in the present disclosure, the term "uphole" refers to a direction in a wellbore that is towards the surface. For example, a first component that is uphole relative to a second component is positioned closer to the surface of the wellbore relative to the second component.

As used in the present disclosure, the term "downhole" refers to a direction further into the formation and away from the surface. For example, a first component that is downhole relative to a second component is positioned farther away from the surface of the wellbore relative to the second component.

As used in the present disclosure, the terms "upstream" and "downstream" may refer to the relative positioning of features of the downhole flow control valves and system with respect to the direction of flow of the wellbore fluids. A first feature of the downhole flow control valve may be considered "upstream" of a second feature if the wellbore fluid flow encounters the first feature before encountering the second feature. Likewise, the second feature may be considered "downstream" of the first feature if the wellbore fluid flow encounters the first feature before encountering the second feature.

As used throughout the present disclosure, the term "fluid" can include liquids, gases, or both and may include solids in combination with the liquids, gases, or both, such as but not limited to suspended solids in the wellbore fluids, entrained particles in gas produced from the wellbore, drilling fluids comprising weighting agents, or other mixed phase suspensions, slurries and other fluids.

As used in the present disclosure, a fluid passing from a first feature "directly" to a second feature may refer to the fluid passing from the first feature to the second feature without passing or contacting a third feature intervening between the first and second feature.

Referring to FIG. 1, a wellbore 100 for producing hydrocarbons from one or more hydrocarbon-bearing subterranean formations 104 is schematically depicted. The wellbore 100 extends from the surface 102 downward to or through one or more hydrocarbon-bearing subterranean formations 104. The wellbore 100 may include a central bore 110 (motherbore). The wellbore 100 may also include a plurality of lateral branches 112. Each of the lateral branches 112 may extend into a different hydrocarbon-bearing subterranean formation 104 at different depths or into different regions of a single hydrocarbon-bearing subterranean formation 104. The central bore 110 can be lined with one or more wellbore casings 114, such as production tubing, which is cemented in place in the central bore 110. The lateral branches 112 may be lined or unlined. When lined, the lateral branches 112 may be perforated to allow hydrocarbon-containing fluids to flow from the hydrocarbon-bearing subterranean formation 104 into the lateral branch 112.

In either case, the conditions of the hydrocarbon-bearing subterranean formation 104 and the composition and properties of the fluids in the hydrocarbon-bearing subterranean formations 104 may be different between lateral branches 112. As previously discussed, the fluids produced in the various lateral branches 112 may have different fluid properties, such as temperature, pressure, viscosity, density, or other properties, depending on the composition of the fluid and formation conditions. Differences in fluid properties between lateral branches 112 can indicate changes in production rate of hydrocarbons from one or more lateral branches 112, such as but not limited to, increases in water or gas production, reduction in formation pressure, or other changes to production rate. These changes to the nature of the fluids in a lateral branch 112 and the changes to hydrocarbon production rate based on these differences may necessitate controlling the production flow rate from one or more of the lateral branches 112.

Inflow control valves are typically installed in the wellbore at each lateral branch during completion of the wellbore to control the flow of fluids produced from each lateral branch and extend the production life of multilateral wells. Inflow control valves installed in multi-lateral wellbores during wellbore completion typically include hydraulic or electronic actuation devices that require hydraulic lines and control lines extending from each inflow control valve to the surface of the wellbore. However, these inflow control valves require frequent operator intervention to change the position of the inflow control valves as well as frequent platform visits for maintenance to trouble shoot inflow control valves to avoid plugging in hydraulic control lines.

Referring to FIGS. 1-3, the present disclosure is directed to downhole flow control valves 120 that are fully automated and systems 300 that include the downhole flow control valves 120 for controlling fluid flow produced from lateral branches 112 of a wellbore 100. Referring to FIG. 3, the downhole flow control valves of 120 the present disclosure may include a valve assembly 130, a driven gear 180, a drive gear 182, and a motor 190. The downhole flow control valves 120, the systems 300, or both may include an electrical power system disposed downhole to power actuation of the downhole flow control valves 120. The downhole flow control valves 120 of the present disclosure do not require or include hydraulic lines and electrical power or control lines extending from the surface 102 downhole to power and control actuation of the valves. In embodiments, the electrical power system may include one or more turbines 124 for generating electrical power downhole. The turbines 124 may be electrically coupled to the motor 190, a battery 126, or both to provide electrical power for actuation of the downhole flow control valves 120. The systems for controlling fluid flow in the lateral branches 112 may also include a system controller 300 that may be operable to communicate wirelessly with the downhole components to automatically control operation of the downhole flow control valves 120. As shown in FIG. 1, a plurality of the downhole flow control valves 120 may be installed in the central bore 110. Each of the downhole flow control valves 120 may be disposed at a junction of the central bore 110 with one of the lateral branches 112. The downhole flow control valves 120 may be separated from each other by a packer 122. Each of the downhole flow control valves 120 may include a turbine 124 positioned so that fluids flowing from the lateral branch 112 into the central bore can rotate the turbine 124 to produce electrical power.

Referring now to FIG. 3, a downhole flow control valve 120 according to the present disclosure is schematically depicted. Each downhole flow control valve 120 includes a valve assembly 130. The valve assembly 130 may include the outer sleeve 140, the inner sleeve 160 disposed within the outer sleeve 140, the driven gear 180 coupled to the inner sleeve 160, and the drive gear 182 engaged with the driven gear 180. The downhole flow control valves 120 may also include at least one motor 190 operatively coupled to the drive gear 182 of the valve assembly 130. Each downhole flow control valve 120 may be coupled to a turbine 124 operable to produce electrical power.

Figure 4A:
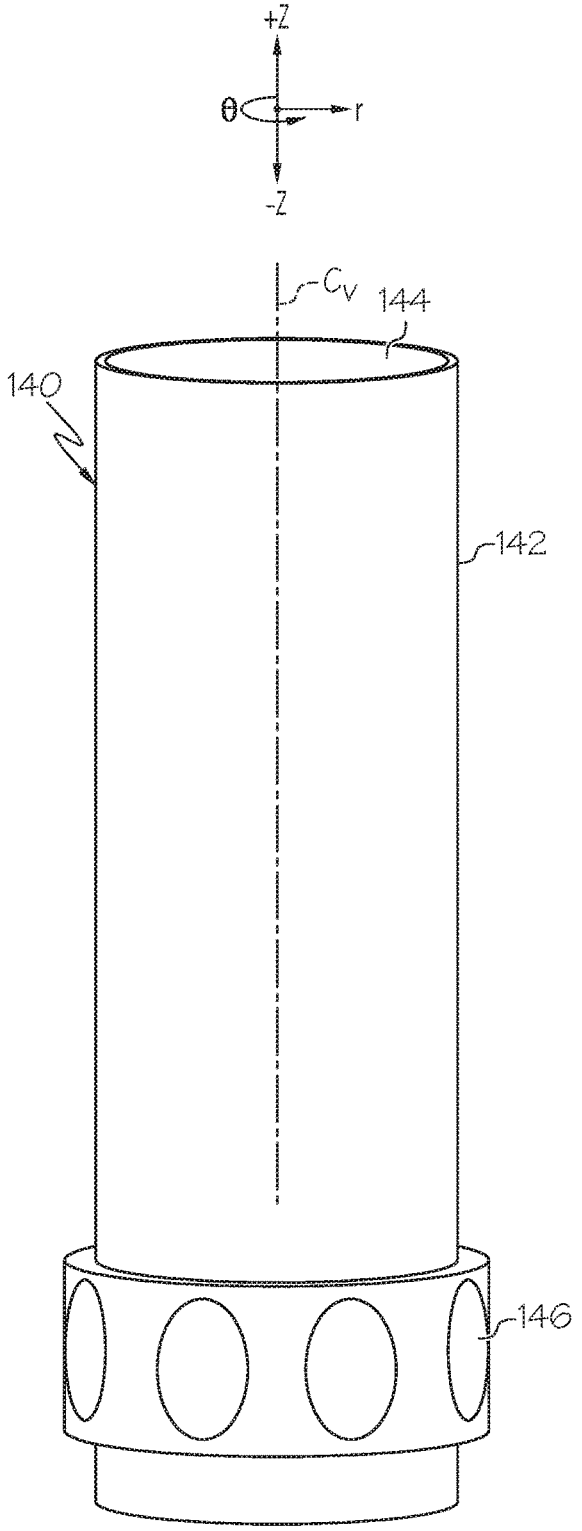
FIG. 4A schematically depicts a side perspective view of an outer sleeve of the downhole flow control valve depicted in FIG. 3, according to one or more embodiments shown and described in this disclosure.
Figure 4B:
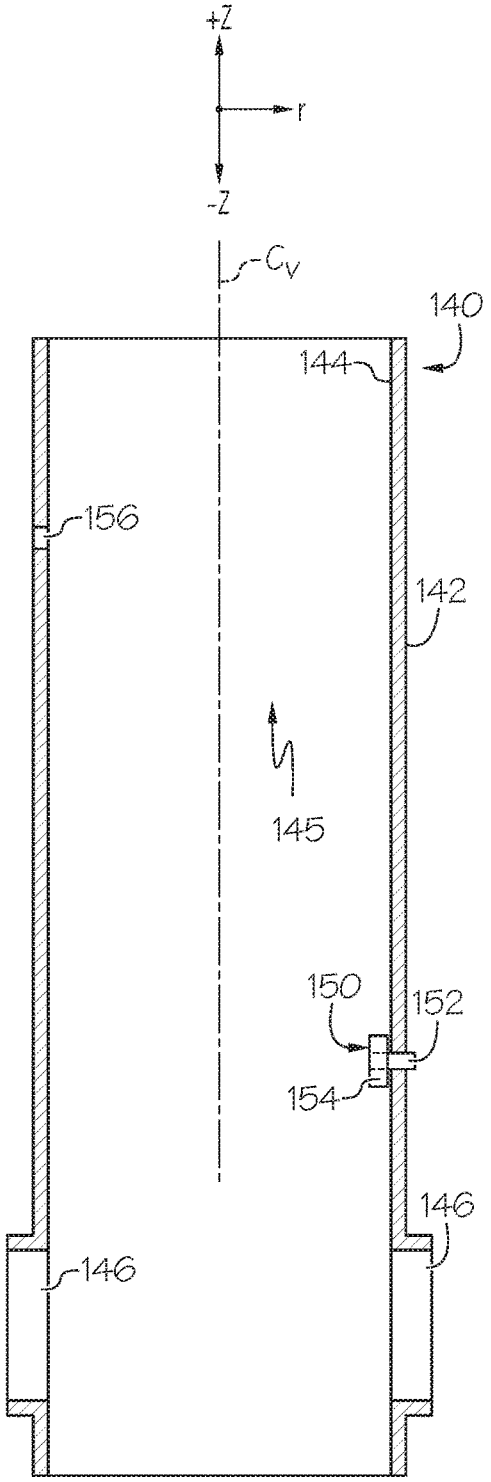
FIG. 4B schematically depicts a side cross-sectional view of the outer sleeve of FIG. 4A, according to one or more embodiments shown and described in this disclosure.

Referring now to FIGS. 4A and 4B, the outer sleeve 140 of the valve assembly 130 may be a hollow cylinder having an outer surface 142 and an inner surface 144. The inner surface 144 may define a cylindrical cavity 145 extending axially (e.g., in the +/−Z direction of the coordinate axis in FIG. 4A) through the outer sleeve 140. The outer sleeve 140 includes one or a plurality of openings 146 extending radially through the outer sleeve 140. The openings 146 may be in fluid communication with the cylindrical cavity 145 defined by the outer sleeve 140 to allow fluids to pass through the outer sleeve 140 from the hydrocarbon bearing subterranean formation 104 to the cylindrical cavity 145 when the downhole flow control valve 120 is in the open position.

Referring now to FIG. 4B, the outer sleeve 140 may further include the fixed guide 150 coupled to the inner surface 144 of the outer sleeve 140 and protruding radially inward from the inner surface 144 of the outer sleeve 140 towards the center axis Cv of the downhole flow control valve 120. At least a portion of the fixed guide 150 may be rigidly coupled to the outer sleeve 140 so that the fixed guide 150 remains in a fixed position relative to the outer sleeve 140 and does not translate in the axial, radial, or angular directions (e.g., the +/−Z, r, or theta (θ) direction of the coordinate axis of FIG. 4B).

In embodiments, the fixed guide 150 may include a pin 152 and a roller 154 coupled to the pin 152. The pin 152 may be rigidly coupled to the outer sleeve 140. The pin 152 may be coupled to the outer sleeve 140 by any known method, such as but not limited to welding, adhering, fastening with one or more fasteners, compression fitting, or other suitable method. The roller 154 may be coupled to the pin 152 and rotatable relative to the pin 152. In embodiments, the pin 152 may form a spindle or axle about which the roller 154 can rotate. Although depicted in FIGS. 4A and 4B as having a pin 152 and roller 154, it is understood that the fixed guide 150 may include other structures, such as a pin or other mass protruding inward from the inner surface 144 of the outer sleeve 140 and without a roller. The outer sleeve 140 may further include an outer pressure equalization port 156 extending through the outer sleeve 140.

Figure 5C:
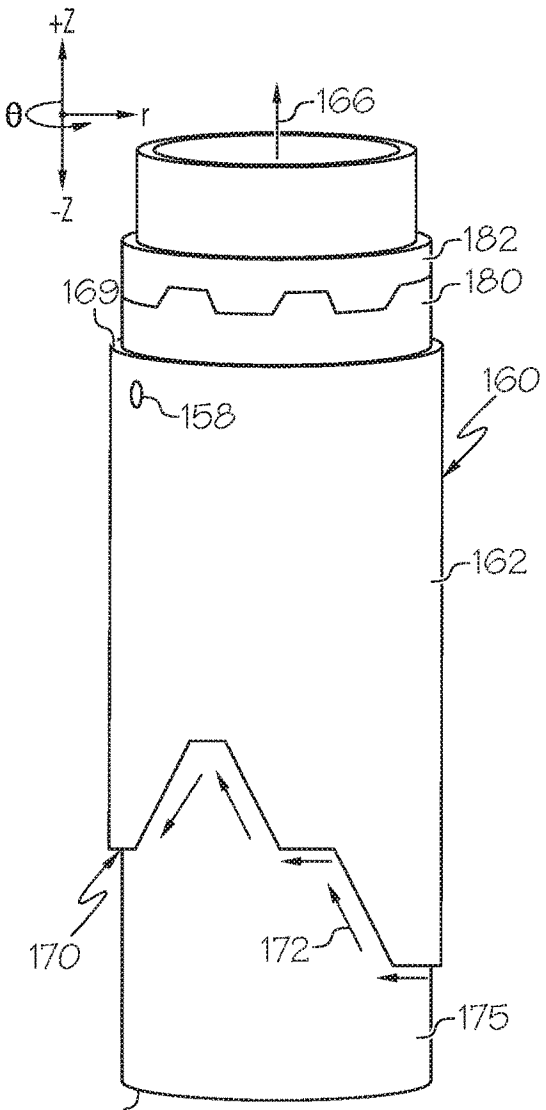
FIG. 5C schematically depicts a side perspective view of another embodiment of an inner sleeve of the downhole flow control valve, according to one or more embodiments shown and described in this disclosure.
Figure 5B:
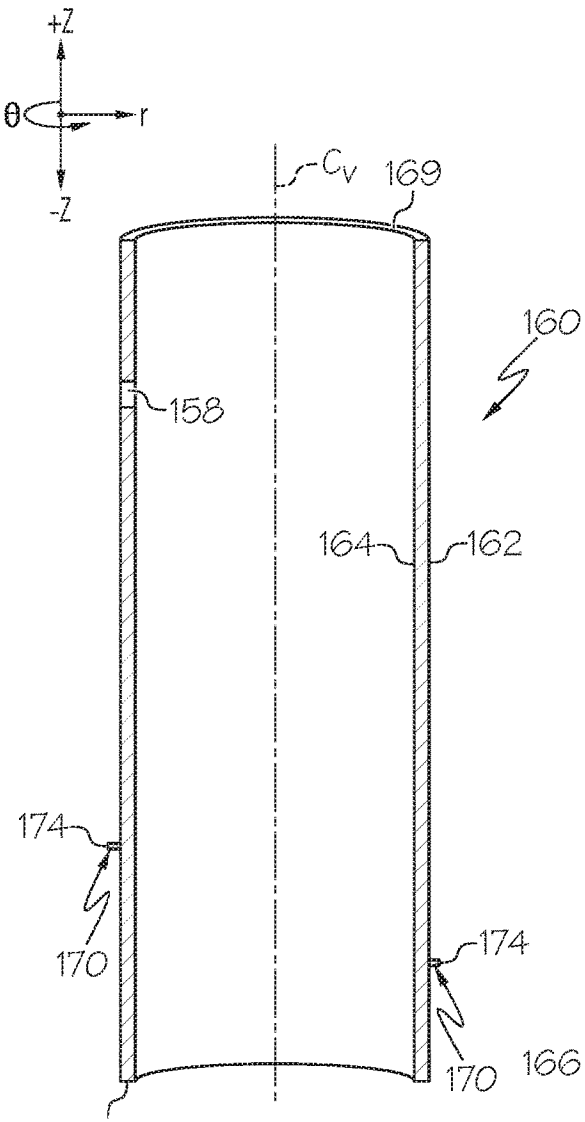
FIG. 5B schematically depicts a side cross-sectional view of the inner sleeve of FIG. 5A, according to one or more embodiments shown and described in this disclosure.
Figure 5A:
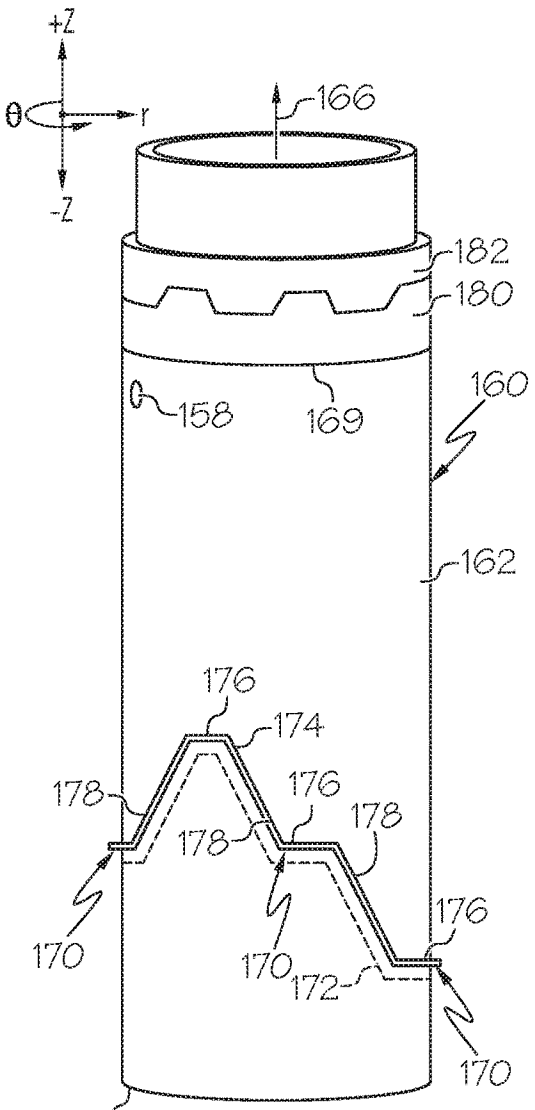
FIG. 5A schematically depicts a side perspective view of an inner sleeve of the downhole flow control valve depicted in FIG. 3, according to one or more embodiments shown and described in this disclosure.

Referring now to FIGS. 5A and 5B, the inner sleeve 160 of the valve assembly 130 may be a hollow cylindrical sleeve having an outer surface 162 and an inner surface 164. The inner surface 164 of the inner sleeve 160 and the inner surface 144 of the outer sleeve 140 may cooperate to define a fluid flow path 166 extending axially through the downhole flow control valve 120. The fluid flow path 166 may allow fluids to flow through the downhole flow control valve 120 in the axial direction (e.g., in the +/−Z direction of the coordinate axis of FIGS. 5A and 5B).

Referring to FIG. 5A, the outer surface 162 of the inner sleeve 160 defines at least one axially abutting surface 170. The axially abutting surface 170 is positioned between the downhole end 168 and the uphole end 169 of the inner sleeve 160 and does not include either of the axial surfaces at the downhole end 168 or uphole end 169 of the inner sleeve 160. The axially abutting surface 170 may refer to a surface of the inner sleeve 160 that restricts axial movement of the fixed guide 150 when the fixed guide 170 abuts up against the axially-abutting surface 170. In embodiments, the axially-abutting surface 170 is a portion of the outer surface 162 for which a line normal to the axially abutting surface 170 has an axial component (e.g., position vector in the +/−Z direction of the cylindrical coordinate axis of FIGS. 5A and 5B) in cylindrical coordinates that is non-zero. It is not required that a line normal to the axially-abutting surface 170 be parallel to the axial direction (e.g., parallel to the +/−Z direction of the coordinate axis of FIGS. 5A and 5B) or parallel to the center axis Cv of the downhole flow control valve 120. The axially abutting surface 170 may be oriented facing towards the downhole end 168 or uphole end 169 of the inner sleeve 160 depending on the orientation of the inner sleeve 160 relative to the outer sleeve 140.

Referring to FIG. 5A, the inner sleeve 160 may include at least one rail 174 protruding outward from the outer surface 162 of the inner sleeve 160. The rail 174 may comprise the axially abutting surface 170. The axially abutting surface 170 may be a surface on either side of the rail 174. The rail 174 may extend around at least a portion of a circumference of the outer surface 162 of the inner sleeve 160. The axially abutting surface 170 of the rail 174 may define a stair-stepped pathway 172 around at least a portion of the outer surface 162 of the inner sleeve 160. In embodiment, the rail 174 may extend partway around a circumference of the outer surface 162 of the inner sleeve 160. In other embodiments, the rail 174 may extend all the way around the circumference of the outer surface 162 of the inner sleeve 160. When the inner sleeve 160 is disposed within the outer sleeve 140, the fixed guide 150 may abut against the axially abutting surface 170 of the inner sleeve 160. The rail 174 may include a plurality of axially-facing segments 176 and one or more transition segments 178 disposed between each of the axially-facing segments 176. The axially-facing segments 176 and the transition segments 178 may cooperate to define the stair-stepped pathway 172 around the outer surface 162 of the inner sleeve 160. In embodiments, the inner sleeve 160 may include two rails 174 spaced apart from each other, where the stair-stepped pathway 172 may be defined between the two rails 174.

Referring to FIG. 5C, in embodiments, the inner sleeve 160 may include a recessed portion 175 of the outer surface 162. The recessed portion 175 may be defined at least in part by the axially-abutting surface 170. The recessed portion 175 may define the stair-stepped pathway 172 around at least a portion of the outer surface 162 of the inner sleeve 160. The axially abutting surface may be disposed at a transition between the recessed portion 175 and the non-recessed portions of the outer surface 162. When the fixed guide 150 of the outer sleeve 140 is disposed in the recessed portion 175 of the inner sleeve 160, the fixed guide 150 may abut against the axially abutting surface 170. The inner sleeve 160 may further include an inner sleeve equalization port 158 extending through the inner sleeve 160

Figure 6A:
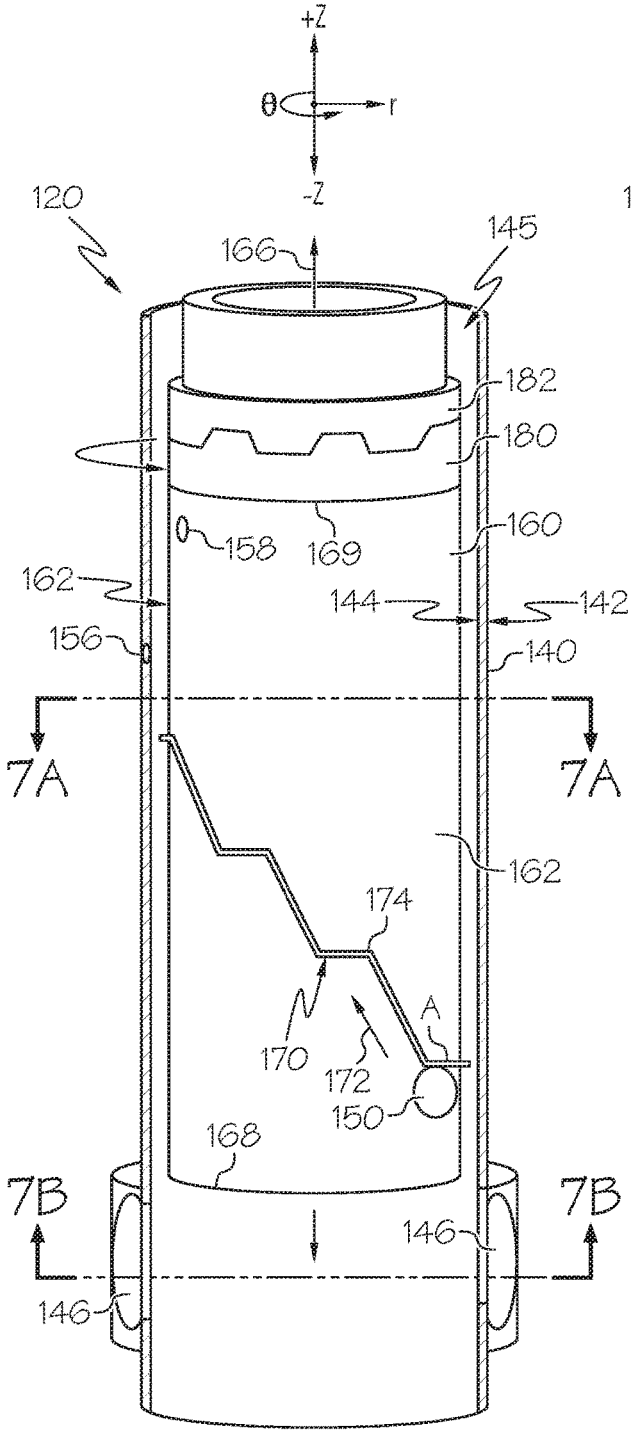
FIG. 6A schematically depicts a side view, in partial cross-section, of the downhole flow control valve of FIG. 3 in an open position, according to one or more embodiments shown and described in this disclosure.
Figure 6B:
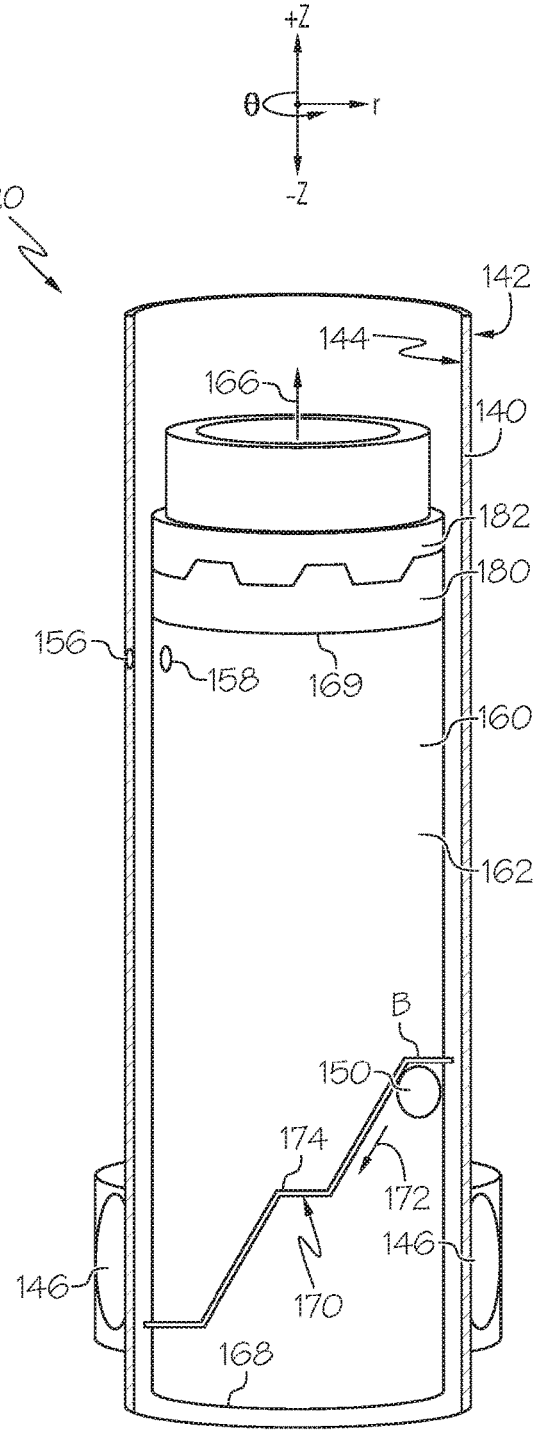
FIG. 6B schematically depicts a side view, in partial cross-section, of the downhole flow control valve of FIG. 3 in a closed position, according to one or more embodiments shown and described in this disclosure.
Figure 7A:
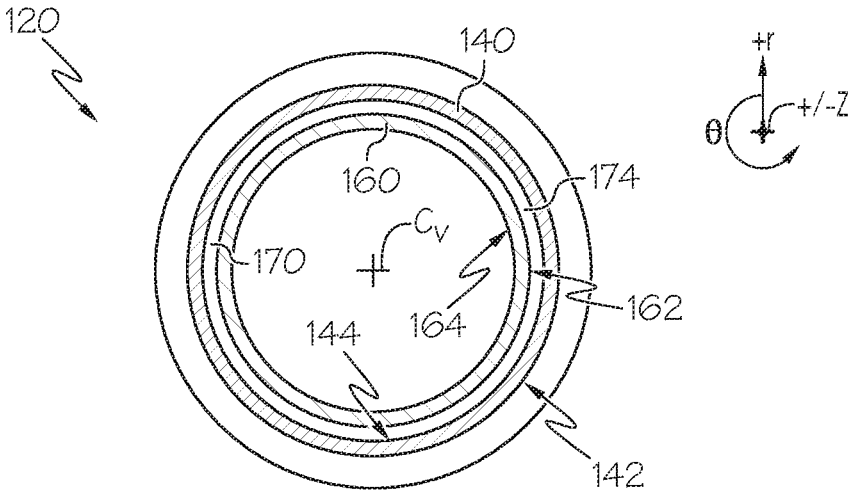
FIG. 7A schematically depicts a top cross-sectional view of the downhole flow control valve of FIG. 6A taken along reference line 7A-7A in FIG. 6A, according to one or more embodiments shown and described in this disclosure.
Figure 7B:
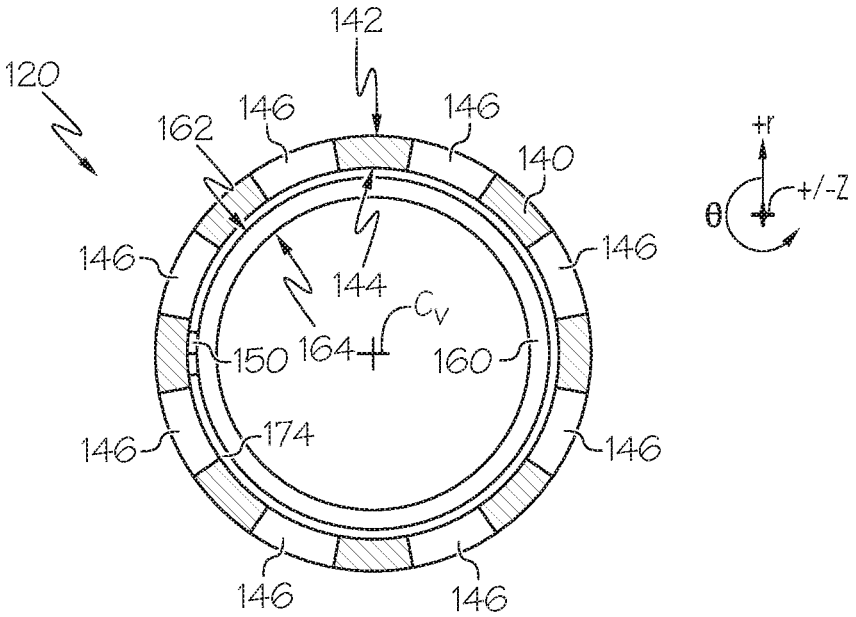
FIG. 7B schematically depicts a bottom cross-sectional view of the downhole flow control valve of FIG. 6A taken along reference line 7B-7B in FIG. 6A, according to one or more embodiments shown and described in this disclosure.

Referring now to FIGS. 6A and 6B, each downhole flow control valve 120 includes the inner sleeve 160 disposed within the outer sleeve 140, such as within the cylindrical cavity 145 of the outer sleeve 140. When the inner sleeve 160 is disposed within the outer sleeve 140, the fixed guide 150 may abut against the axially abutting surface 170 of the inner sleeve 160. The inner sleeve 160 may be biased in the downward direction (−Z direction of the coordinate axis in FIGS. 6A and 6B) to maintain contact of the axially abutting surface 170 of the inner sleeve 160 with the fixed guide 150. The fixed guide 150 limits travel of the inner sleeve 160 in the downward direction. Referring now to FIG. 7A, a top cross-sectional view of the downhole flow control valve 120 of FIG. 6A taken along reference line 7A-7A in FIG. 6A is schematically depicted. As shown in FIG. 7A, the inner sleeve 160 may be spaced apart radially from the outer sleeve 140, and the rail 174 may extend radially at least partway between the inner sleeve 160 and the outer sleeve 140. FIG. 7B schematically depicts a bottom cross-sectional view of the downhole flow control valve 120 of FIG. 6A taken along reference line 7B-7B in FIG. 6A. FIG. 7B shows the fixed guide 150 in the foreground with the axially abutting surface 170 of the inner sleeve 160 in the background.

Referring again to FIG. 6A, the downhole flow control valve 120 is schematically depicted in an open position. In the open position, the openings 146 in the outer sleeve 140 may be in fluid communication with the fluid flow path 166 defined by the inner surface 164 of the inner sleeve 160 and inner surface 144 of the outer sleeve 140 through the center of the downhole flow control valve 120. As shown in FIG. 6A, the fixed guide 150 may abut against and contact the axially abutting surface 170 at a first position A when the inner sleeve 160 is in the open position. The outer sleeve 140 may generally be fixed in the wellbore and the inner sleeve 160 may be rotatable relative to the outer sleeve 140. When the inner sleeve 160 is rotated in a first direction relative to the outer sleeve 140, abutment of the fixed guide 150 against the axially abutting surface 170 of the inner sleeve 160 may cause the inner sleeve 160 to translate in the axial direction (+/−Z direction) between the open position and a closed position relative to the outer sleeve 140.

Referring to FIG. 6B, the downhole flow control valve 120 is schematically depicted in the closed position, in which the fixed guide 150 may abut against and contact the axially abutting surface 170 at a second position B. When the position B of the axially abutting surface 170 is in contact with the fixed guide 150, a portion of the inner sleeve 160 blocks the openings 146 in the outer sleeve 140 so that the openings 146 are not in fluid communication with the fluid flow path 166 defined through the downhole flow control valve 120. Rotation of the inner sleeve 160 relative to the outer sleeve 140 may cause the fixed guide 150 to move along the stair-stepped path 172 defined by the axially abutting surface 170. As the inner sleeve 160 rotates, the abutment of the fixed guide 150 with the axially abutting surface 170 in the transition segments 178 may cause the inner sleeve 160 to move axially relative to the outer sleeve 140. Rotation of the inner sleeve 160 in a first direction may cause the inner sleeve 160 to translate axially from the open position of FIG. 6A to the closed position of FIG. 6B. Rotation of the inner sleeve 160 in a second direction opposite the first direction may cause the inner sleeve 160 to translate axially from the closed position of FIG. 6B back to the open position of FIG. 6A.

Figure 8C:
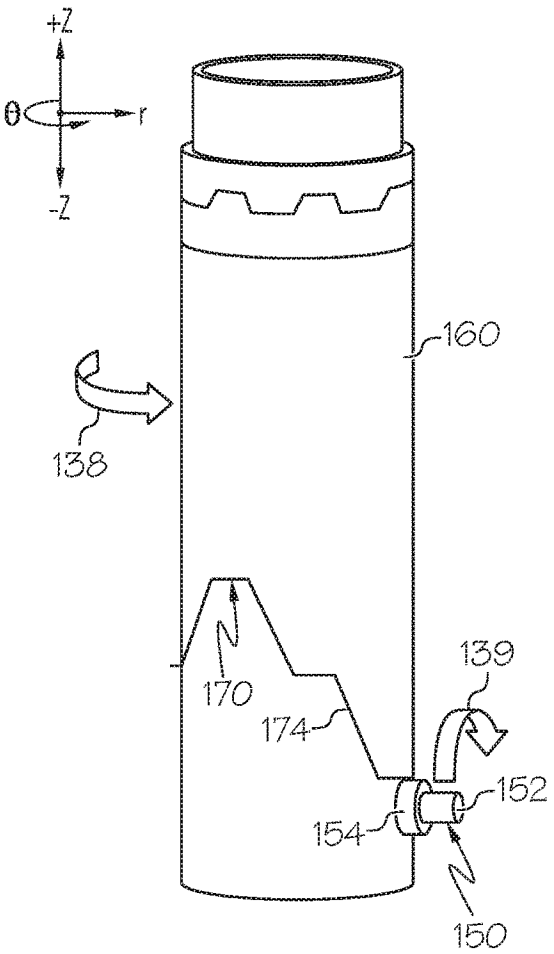
FIG. 8C schematically depicts a side perspective view of the inner sleeve and fixed guide of FIG. 8B in which the inner sleeve has been further rotated in the first direction to return the inner sleeve to the open position, according to one or more embodiments shown and described in this disclosure.
Figure 8B:
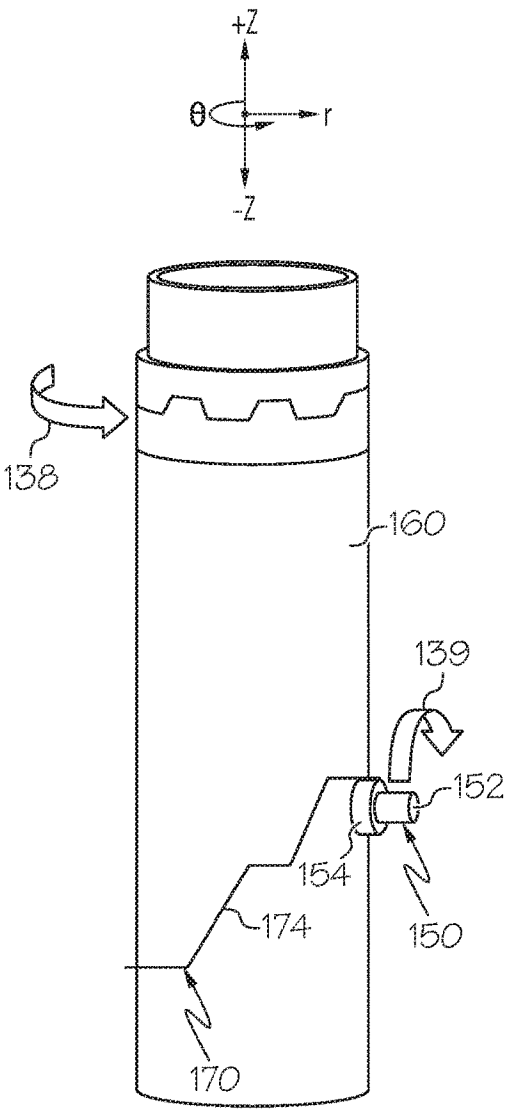
FIG. 8B schematically depicts a side perspective view of the inner sleeve and fixed guide of FIG. 8A in which the inner sleeve has been rotated in a first direction into a closed position, according to one or more embodiments shown and described in this disclosure.
Figure 8A:
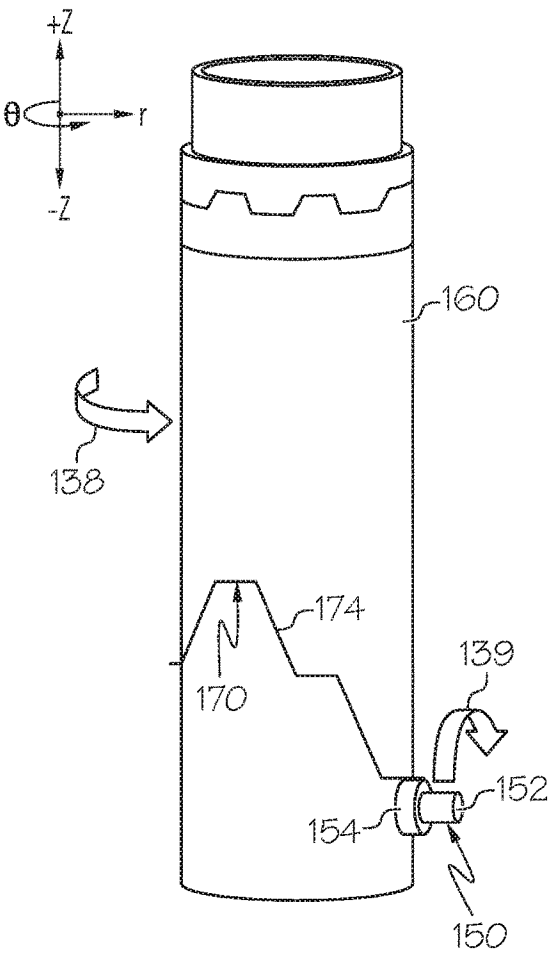
FIG. 8A schematically depicts a side perspective view of an inner sleeve and fixed guide of the downhole flow control valve of FIG. 6A in an initial open position, according to one or more embodiments shown and described in this disclosure.

Referring to FIGS. 8A, 8B, and 8C, in embodiments, the axially abutting surface 170 may extend all the way around the circumference of the outer surface 162 of the inner sleeve 160. The axially abutting surface 170 may rejoin itself so that the stair-stepped pathway 172 is continuous around the outer surface 162 of the inner sleeve 160. In embodiments, the axially abutting surface 170 may be shaped so that the stair-stepped pathway 172 steps up to a position of maximum axial travel at 180 degrees of rotation of the inner sleeve 160 and then steps back down to the starting position at 360 degrees of rotation of the inner sleeve 160. In these embodiments, rotation of the inner sleeve 160 in a single direction 138 can transition the inner sleeve 160 from the open position of FIG. 8A to the closed position of FIG. 8B, and then to the open position again in FIG. 8C. The single direction 138 can be clockwise or counterclockwise (e.g., in the + or − theta direction of the coordinate axis in FIG. 8B). As previously discussed, the fixed guide 150 may include the pin 152 and roller 154, which may be rotatable in the direction 139 (shown as clockwise in FIGS. 8A-8C) relative to the pin 152. The rotation direction 139 of roller 154 depends on the rotation direction 138 of the inner sleeve 160. The roller 154 may contact the axially abutting surface 170. As the inner sleeve 160 rotates in the single direction 138, abutment of the roller 154 with the axially abutting surface 170 may cause the roller 154 to rotate as the fixed guide 150 traverses along the stair-stepped pathway 172. Although the inner sleeve 160 is shown and described in the present disclosure in the context of translating in the downhole or −Z direction into the closed position and in the uphole or +Z direction into the open position, it is understood that the inner sleeve 160 and outer sleeve 140 may be configured so that the inner sleeve 160 translates downhole or in the −Z direction to transition the inner sleeve 160 into the open position.

Referring again to FIGS. 6A and 6B, the downhole flow control valve 120 may include a driven gear 180 rigidly coupled to an end of the inner sleeve 160. The driven gear 180 may be rigidly coupled to the uphole end 169 or the downhole end 168 of the inner sleeve 160, depending on which direction the inner sleeve 160 translates axially from the open position to the closed position. In embodiments represented by the schematic depictions in FIGS. 6A and 6B, the driven gear 180 may be rigidly coupled to the uphole end 169 of the inner sleeve 160. The downhole flow control valve 120 may further include a drive gear 182 engaged with the driven gear 180. Active rotation of the drive gear 182 may rotate the driven gear 180 and the inner sleeve 160 coupled to the driven gear 180 relative to the outer sleeve 140.

Figure 9:
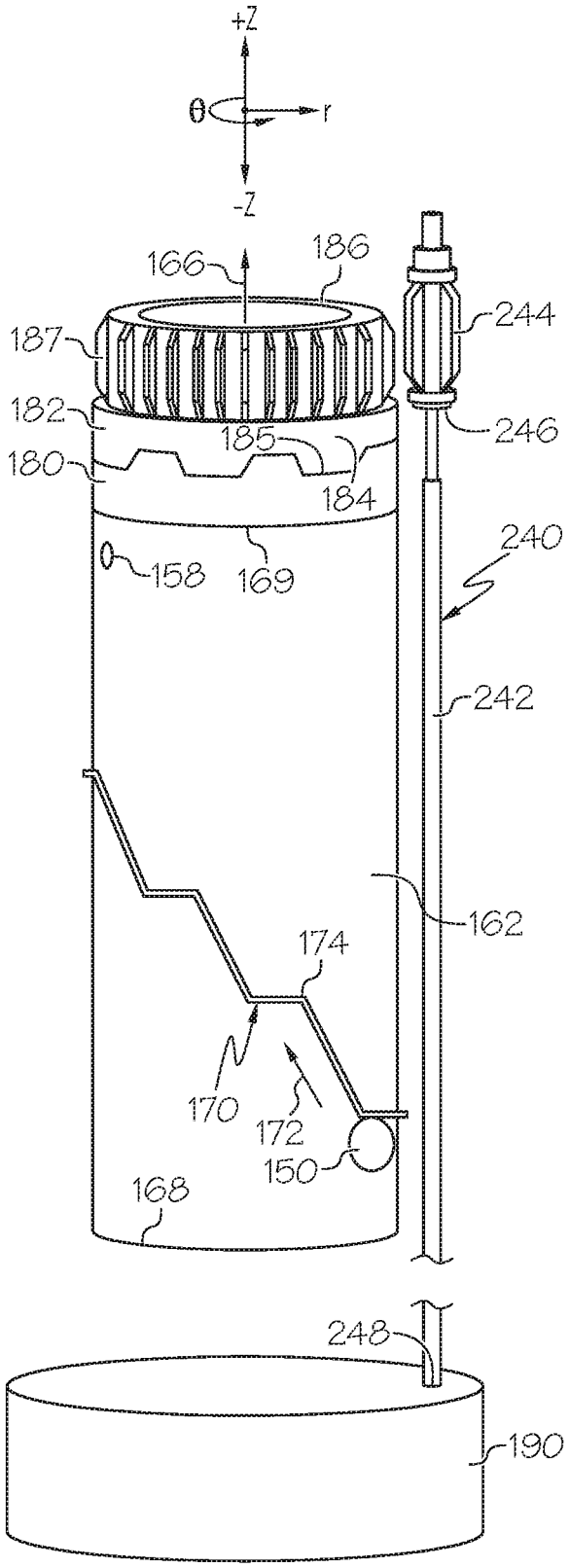
FIG. 9 schematically depicts a side perspective view of a linkage between a drive gear and a motor of the system of FIG. 2, according to one or more embodiments shown and described in this disclosure.

Referring again to FIG. 3, the downhole flow control valve 120 may include a motor 190 operatively coupled to the drive gear 182 of the downhole flow control valve 120 to rotate the drive gear 182. As previously discussed, rotation of the drive gear 182 may rotate the driven gear 180 and the inner sleeve 160 rigidly coupled to the driven gear 180. The motor 190 may be operatively coupled to the drive gear 182 through one or a plurality of linkages. Referring now to FIG. 9, the drive gear 182 may be linked to the motor 190 by a drive shaft assembly 240. The drive gear 182 may include one or a plurality of axially facing teeth 185 that may engage with the driven gear 180. The drive gear 182 may also include a plurality of radially facing teeth 187 facing radially outward from the drive gear 182. In embodiments, the drive gear 182 may include a downhole portion 184 comprising the axially facing teeth 185 and an uphole portion 186 comprising the radially facing teeth 187. The drive shaft assembly 240 may include a drive shaft 242 and a drive gear linkage 244 coupled to an uphole end 246 of the drive shaft 242. A downhole end 248 of the drive shaft 242 may be operatively coupled to the motor 190 so that the motor 190 can turn the drive shaft 242. The drive gear linkage 244 may have a plurality of teeth that may be engaged with the radially facing teeth 187 of the drive gear 182. During operation of the motor 190 to transition the inner sleeve 160 between the open and closed position, the motor 190 may rotate the drive shaft 242. Rotation of the drive shaft 242 may rotate the drive gear linkage 244. Engagement of the teeth of the drive gear linkage 244 with the radially facing teeth 187 of the drive gear 182 may cause the drive gear 182 to rotate in response to rotation of the drive shaft 242. As previously discussed, rotation of the drive gear 182 may cause the inner sleeve 160 to translate in the axial direction (+/−Z direction of the coordinate axis in FIG. 9) between the open and closed positions. Rotation of the drive shaft 242 may also translate the drive shaft 242 in the axial direction (+/−Z direction of the coordinate axis in FIG. 9) to maintain contact of the drive gear linkage 244 with the drive gear 182 as the inner sleeve 140, driven gear 180, and drive gear 182 move in the axial direction in response to operation of the motor.

Figure 10:
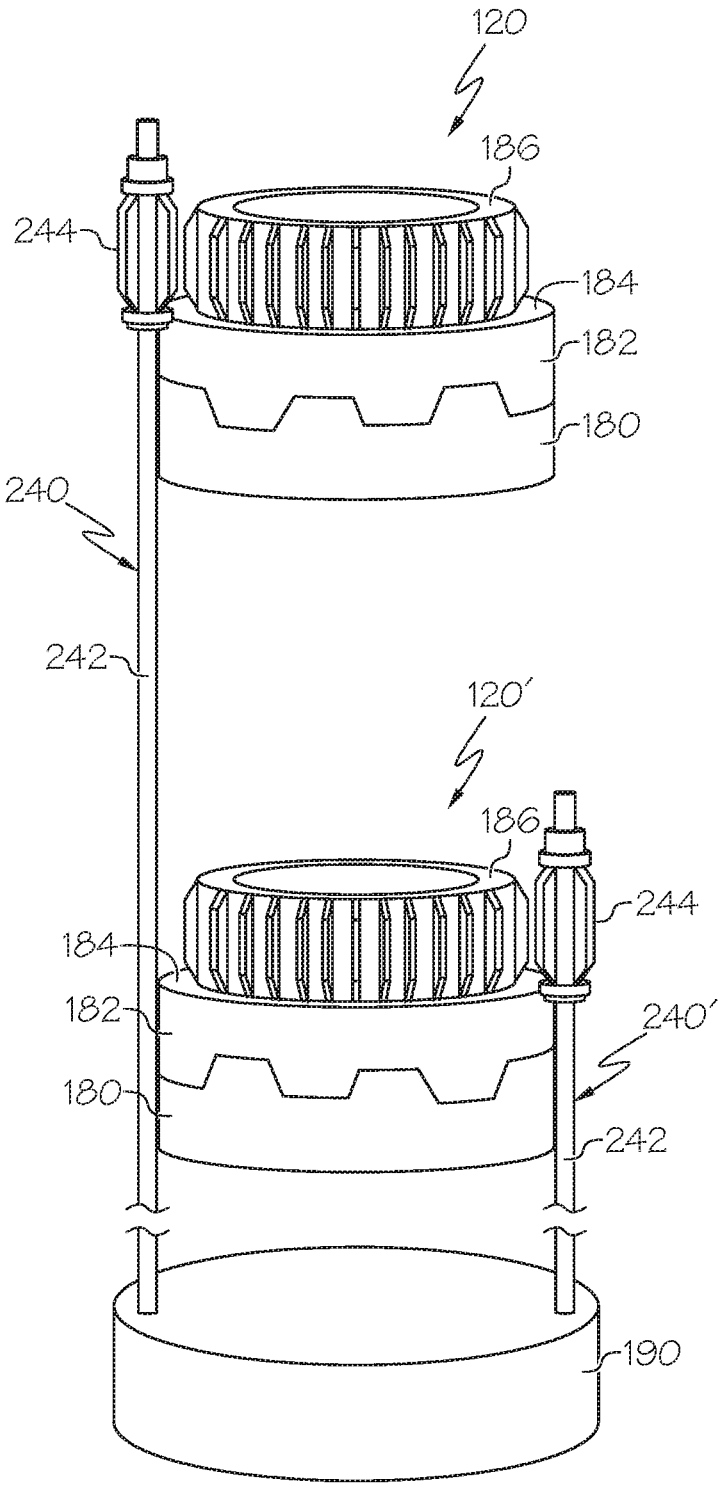
FIG. 10 schematically depicts a side perspective view of portions of a linkage between a motor and drive gears of a plurality of flow control valves for the system of FIG. 2, according to one or more embodiments shown and described in this disclosure.

The motor 190 may be operatively coupled to the drive gears 182 of a plurality of downhole flow control valves 120 so that the single motor 190 can operate each of the plurality of downhole flow control valves 120 independently. Referring to FIG. 10, a first drive shaft assembly 240 may operatively couple the motor 190 to the drive gear 182 of one downhole flow control valve 120, and a second drive shaft assembly 240' may operatively couple the motor 190 to the drive gear 182' of another downhole flow control valve 120'. The motor 190 may be operable to rotate each drive shaft assembly 240, 240' independently so that the downhole flow control valves 120, 120' can be operated independent of one another. In FIG. 10, the inner and outer sleeves of the downhole flow control valves 120, 120' are omitted for purposes of illustration. Although shown as having two downhole flow control valves 120, 120' in FIG. 10, it is understood that the motor 190 may be operatively coupled to more than two downhole flow control valves 120, 120' through a plurality of drive shaft assemblies.

The motor 190 may be any type of motor suitable for rotating the drive gears 182. The motor 190 may be suitable for operating under downhole conditions, such as at temperatures up to or even exceeding 250 degrees Celsius (° C.) and typical downhole pressures. The motor 190 may be an electric motor.

Rotation of the inner sleeve 160 in a first direction through operation of the motor 190, drive gear 182, and driven gear 180 may cause the inner sleeve 160 to translate in an axial direction from the open position to the closed position through abutment of the fixed guide 150 with the axially abutting surface 170 of the inner sleeve 160. Further rotation of the inner sleeve 160 in the first direction or rotation of the inner sleeve 160 in a second direction opposite the first direction through operation of the motor 190, drive gear 182, and driven gear 180, may translate the inner sleeve 160 in an axial direction from the closed position back into the open position through abutment of the fixed guide 150 with the axially abutting surface 170 of the inner sleeve 160. Referring again to FIGS. 6A and 6B, the outer sleeve pressure equalization port 156 and the inner sleeve pressure equalization port 158 may cooperate to equalize the pressure in the space between the outer sleeve 140 and the inner sleeve 160 during actuation of the downhole flow control valve 120 to translate the inner sleeve 160 between the open and closed positions.

Referring now to FIGS. 11A-11D, the downhole flow control valve 120 may include a manually operated sleeve 200 that may be manually positioned to block the openings 146 in the outer sleeve 140. The manually operated sleeve 200 may be included as a backup method of closing the downhole flow control valve 120 in the event of power failure or failure of the inner sleeve 160 to translate into and out of position automatically. The manually operated sleeve 200 may be independent of the inner sleeve 160 of the downhole flow control valve 120. The manually operated sleeve 200 may be disposed within the outer sleeve 140 and positioned so that the manually operated sleeve 200 does not interfere with operation of the inner sleeve 160. In embodiments, the manually operated sleeve 200 may be disposed downhole relative to the inner sleeve 160.

Figure 11A:
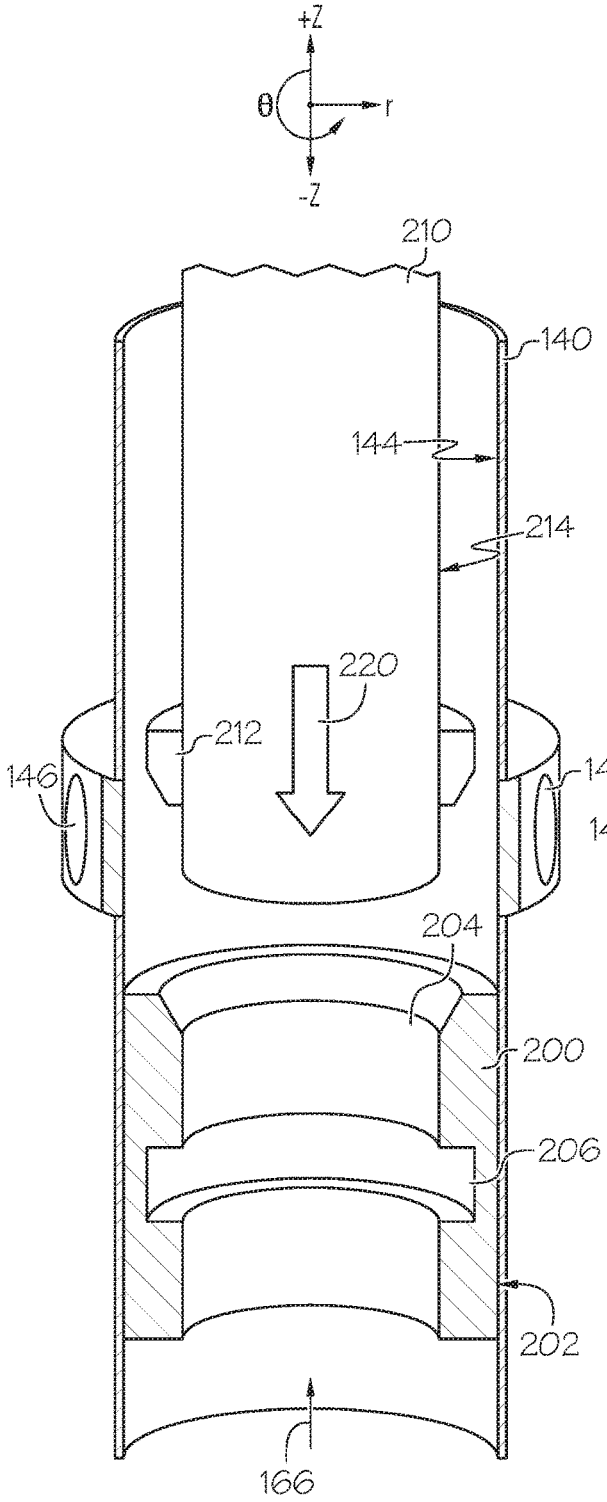
FIG. 11A schematically depicts a side cross-sectional view of a downhole flow control valve having a manually operated sleeve as a backup, according to one or more embodiments shown and described in this disclosure.

Referring to FIG. 11A, the manually operated sleeve 200 may be a hollow cylindrical sleeve having an outer surface 202 and an inner surface 204. The outer surface 202 may contact the inner surface 142 of the outer sleeve 140. The inner surface 204 may define at least a portion of the fluid flow path 166 through the downhole flow control valve 120. The inner surface 204 may additionally include one or more notches 206 shaped to receive an outer profile of a wireline key tool 210 or slickline tool. The wireline key tool 210 may have one or more retractable tabs 212 protruding radially outward from an outer surface 214 of the wireline key tool 210. The notches 206 of the manually operated sleeve 200 may be shaped to receive the retractable tabs 212 of the wireline key tool 210 to enable the wireline key tool 210 to engage with the manually operated sleeve 200. In embodiments, the notches 206 may comprise a continuous annular notch in the inner surface 204 of the manually operated sleeve 200. The retractable tabs 212 may be biased radially outward from the wireline key tool 210.

Figure 11B:
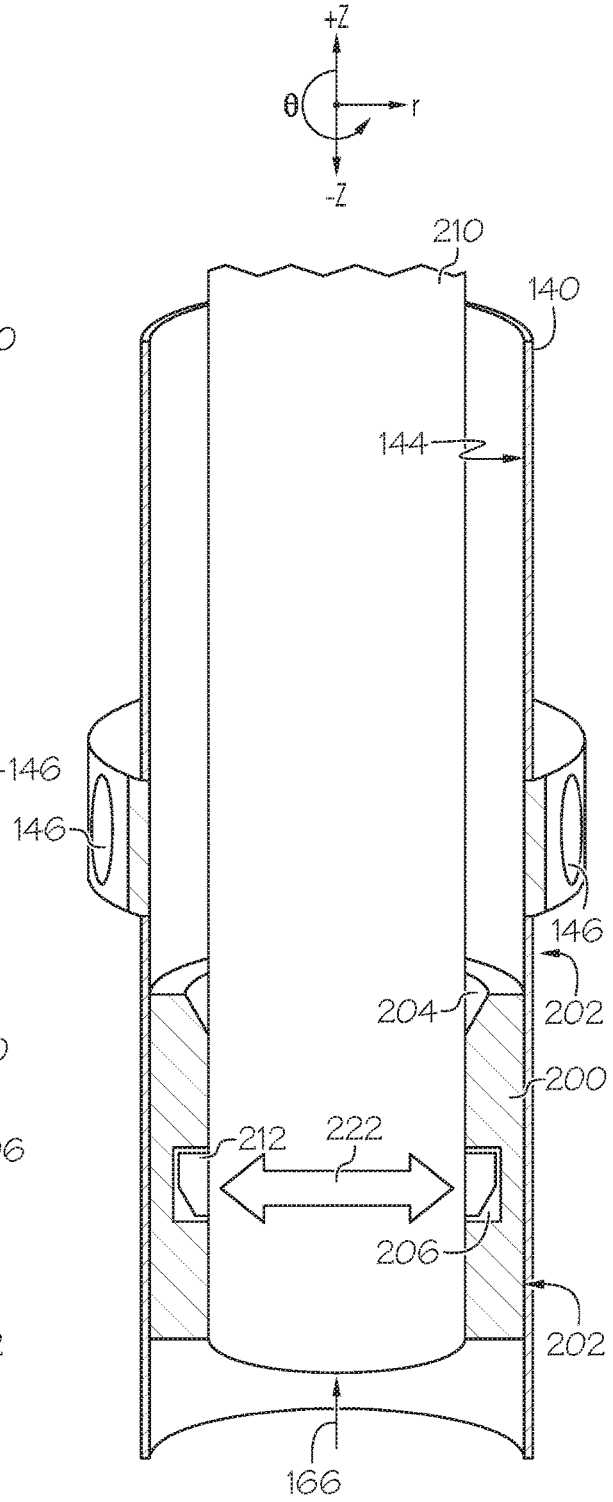
FIG. 11B schematically depicts a side cross-sectional view of the downhole flow control valve of FIG. 11A in which a wireline tool is engaged with the manually operated sleeve, according to one or more embodiments shown and described in this disclosure.

Referring to FIGS. 11A and 11B, during operation of the manually operated sleeve 200, the wireline key tool 210 may be inserted into the wellbore, as indicated by arrow 220 in FIG. 11A. The wireline key tool 210 may land in the profile defined by the inner surface 204 of the manually operated sleeve 200 and latch into the profile, as shown in FIG. 11B. In particular, the force of initial contact of the inner surface 204 of the manually operated sleeve 200 may cause the retractable tabs 212 of the wireline key tool 210 to retract. When the wireline key tool 210 is moved downward to the position where the retractable tabs 212 are aligned with the notches 206, the spring mechanism or other biasing mechanism may bias the retractable tabs 212 of the wireline key tool 210 radially outward so that the retractable tabs 212 engage with the notches 206 to latch the wireline key tool 210 to the manually operated sleeve 200. The outward biasing of the retractable tabs 212 to latch the wireline key tool 210 to the manually operated sleeve 200 is indicated by double-headed arrow 222 in FIG. 11B.

Figure 11C:
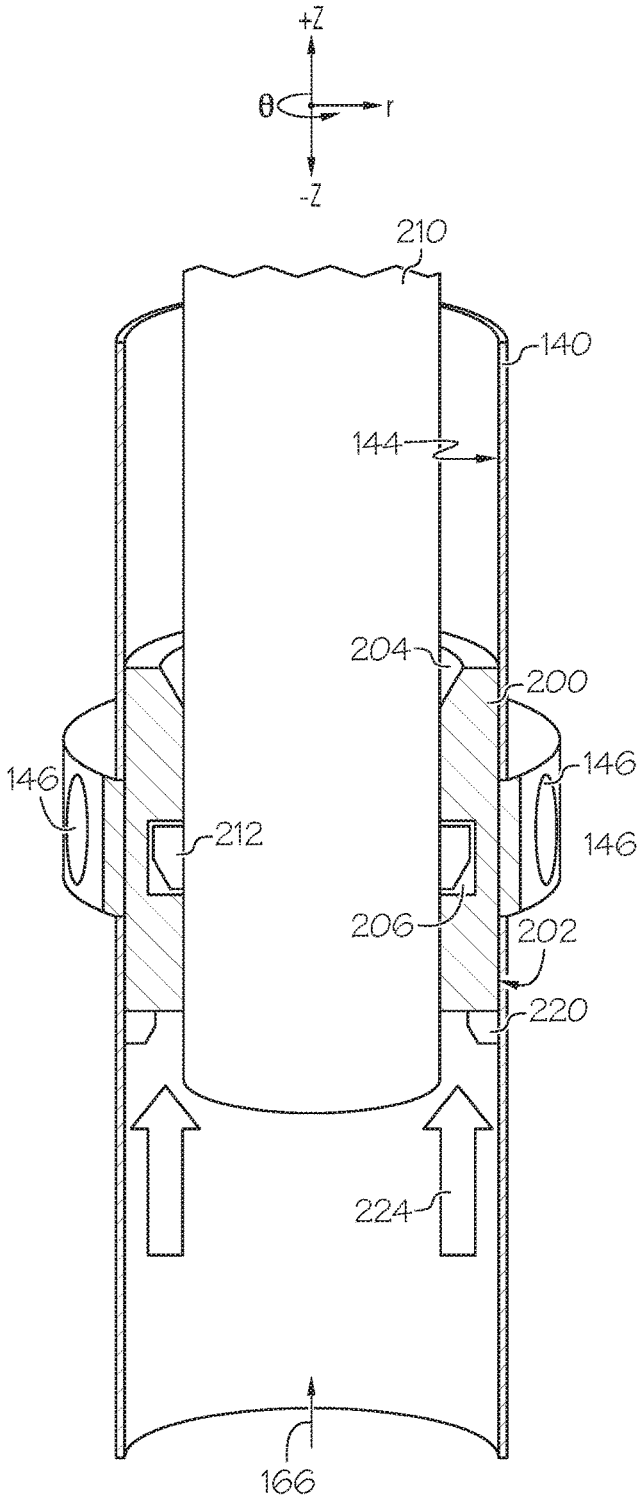
FIG. 11C schematically depicts a side cross-sectional view of the downhole flow control valve of FIG. 11B in which the wireline tool has been used to move the manually operated sleeve into a closed position, according to one or more embodiments shown and described in this disclosure.
Figure 11D:
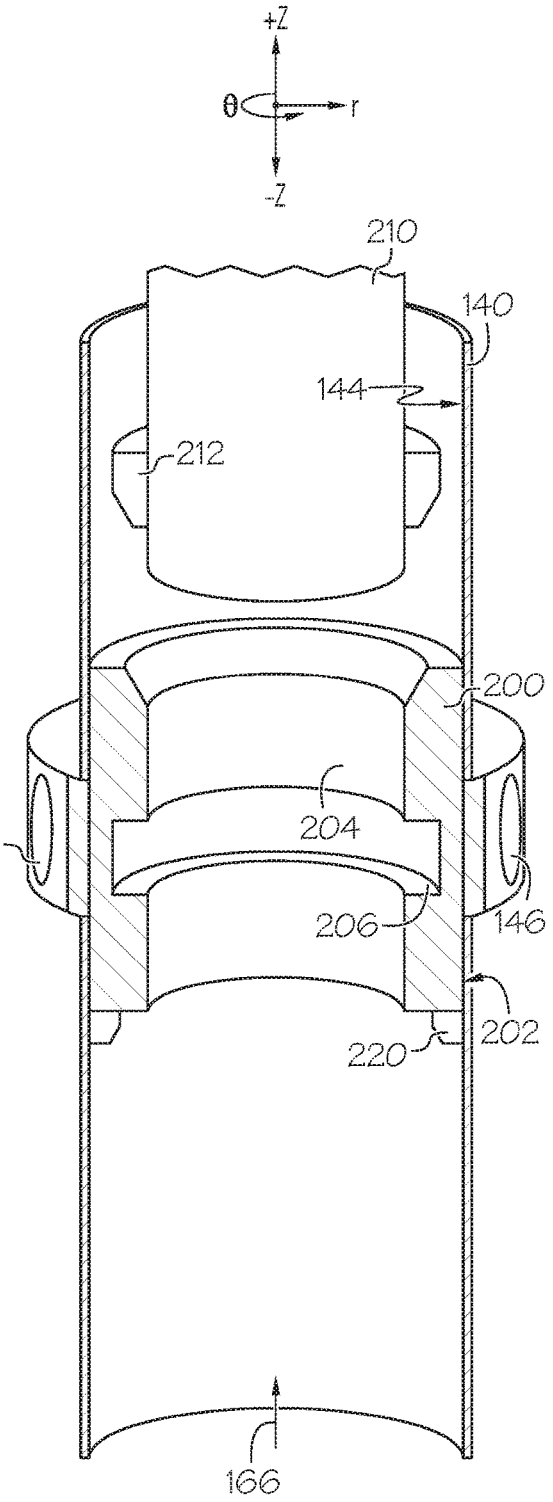
FIG. 11D schematically depicts a side cross-sectional view of the downhole flow control valve of FIG. 11C in which the wireline tool has been disengaged from the manually operated sleeve in the closed position, according to one or more embodiments shown and described in this disclosure.

Referring now to FIG. 11C, after confirming the latching of the wireline key tool 210 to the manually operated sleeve 200, the wireline key tool 210 may be pulled uphole (e.g., in the +Z direction of the coordinate axis in FIG. 11C). Pulling the wireline key tool 210 in the uphole direction may translate the manually operated sleeve 200 upward as shown by arrows 224 in FIG. 11C into a closed position, in which the manually operated sleeve 200 covers the openings 146 in the outer sleeve 140 to prevent flow of fluids from the lateral branch into the fluid flow path 166 defined through the downhole flow control valve 120. Referring to FIG. 11D, when a threshold force (over-pull force) is reached, the wireline key tool 210 will shear (e.g., the retractable tabs 212 retracted into the body of the key tool by overcoming the biasing force of the spring mechanism or other biasing mechanism) to release the wireline key tool 210 from the profile of the manually operated sleeve 200. The wireline key tool 210 may be removed from the wellbore 100 to continue operations.

Referring again to FIG. 3, the downhole flow control valve 120 may include a downhole electrical power source for producing electrical power to operate the motor 190. The downhole electrical power source may include a turbine 124 coupled to the outer sleeve 140 of the downhole flow control valve 120 and rotatable relative to the outer sleeve 140. The turbine 124 may be coupled directly to the outer sleeve 140 or coupled to a spacer or other structure coupled to the outer sleeve 140. The turbine 124 may be positioned so that fluid flowing from the lateral branch 112 into the downhole flow control valve 120 can turn the turbine 124. The turbine 124 may be operable to generate electrical power when the turbine 124 is rotated by the fluid flowing from the lateral branch 112 or the central bore 110 into the downhole flow control valve 120. The turbine 124 may include a flow path through a center of the turbine 124 to allow fluid flow through the central bore 110, whether or not the downhole flow control valve 120 is in the open position.

The turbine 124 may be electrically coupled to the motor 190 to supply at least a portion of the electrical power for operation of the motor 190. The downhole electrical power source may further include one or a plurality of batteries 126 electrically coupled to the motor 190, the turbine 124, or both. The batteries 126 may supply at least another portion of the electrical power for operation of the motor 190. The batteries 126 may be rechargeable batteries and may be electrically coupled to the turbine 124. The turbine 124 may supply electrical power to charge the battery 126 when the motor 190 is not actively operating and drawing electrical power.

Referring to FIGS. 2 and 3, a plurality of downhole flow control valves 120 and a plurality of the turbines 124 may be installed in the wellbore 100. Each of the turbines 124 may be physically coupled to one of the downhole flow control valves 120. The plurality of turbines 124 may be electrically coupled together and to the motor 190, the batteries 126, or both. When the plurality of turbines 124 are electrically coupled together and to the motor 190, the batteries 126, or both, electrical power may be generated to run the motor 190 by the turbines 124 coupled to downhole flow control valves 120 that are in the open position, even when one or more of the downhole flow control valves 120 are in the closed positon. Thus, as long as one downhole flow control valve 120 is in the open position, fluid flowing from the lateral branch 112 or central bore 110 can rotate the turbine 124 to generate power for operation of the motor 190. When none of the downhole flow control valves 120 is in the open positon, the batteries 126 may provide the electrical power for operation of the motor. Thus, the downhole flow control valves 120 may be independently powered so that they do not rely on electrical power or hydraulic power from the surface of the wellbore.

Referring to FIG. 3, each of the downhole flow control valves 120 may include one or a plurality of sensors 230 operable to measure one or more properties of a fluid in contact with the downhole flow control valves 120, such as fluid in the lateral branch 112 at which the downhole flow control valve 120 is installed. The sensors 230 may be electrically coupled to the batteries 126, the turbines 124, or both to supply electrical power to the sensors 230. In embodiments, each of the sensors 230 may include a self-contained power source, such as a sensor battery, for example. The sensors 230 may include one or more of a production pressure sensor, a fluid density sensor, a viscosity sensor, a temperature sensor, or combinations of these. Other types of sensors for measuring other properties of the fluid in the lateral branch 112 are contemplated.

Referring to FIGS. 1-3, the downhole flow control valves 120 of the present disclosure may be incorporated into a system 300 for controlling fluid flow in one or more of the lateral branches 112 of a multilateral wellbore 100. The system 300 may include a plurality of the downhole flow control valves 120, a plurality of packers 122, a motor 190, and an electrical power source, such as the turbines 124, batteries 126, or both. Referring to FIG. 3, the system 300 may further include a motor controller 192 operatively coupled to the motor 190. The system 300 may further include one or a plurality of sensors 230 coupled to each of the downhole flow control valves 120. Referring to FIG. 1, the system 300 may further include a system controller 301.

Referring to FIGS. 6A and 6B, as previously described, each downhole flow control valve 120 may include the outer sleeve 140, the inner sleeve 160, the driven gear 180, and the drive gear 182. The outer sleeve 140 of each downhole flow control valve 120 may include the one or more openings 146 and the fixed guide 150 coupled to the inner surface 144 of the outer sleeve 140. The inner sleeve 160 is disposed within the outer sleeve 140. The inner surfaces 144, 164 of the inner sleeve 160 and the outer sleeve 140 of each downhole flow control valve 120 may define the fluid flow path 166 extending axially through the downhole flow control valve 120. The outer surface 162 of the inner sleeve 160 of each downhole flow control valve 120 may include the axially abutting surface 170 defining the stair-stepped pathway 172 on at least a portion of the outer surface 162 of the inner sleeve 160. The fixed guide 150 of the outer sleeve 140 may abut against the axially abutting surface 170 of the outer surface 162 of the inner sleeve 160. The driven gear 180 may be rigidly coupled to one end of the inner sleeve 160, and the drive gear 182 may be engaged with the driven gear 180 to rotate the driven gear 180 and the inner sleeve 160 relative to the outer sleeve 140. Abutment of the fixed guide 150 of the outer sleeve 140 against the axially abutting surface 170 of the inner sleeve 160 causes the inner sleeve 160 to translate in an axial direction between the open position and the closed position relative to the outer sleeve 140 when the inner sleeve 160 is rotated. Each of the plurality of downhole flow control valves 120 may have any of the other additional features previously described in the present disclosure for the downhole flow control valves 120.

Referring again to FIGS. 2 and 3, as previously discussed, the electrical power source may include a plurality of turbines 124, one or more batteries 126, or both. The electrical power source may be electrically isolated from the surface 102 of wellbore 100 when the system 300 including the plurality of downhole flow control valves 120 is installed in the wellbore 100. The system 300 may include the plurality of turbines 124, each of which may be operable to produce electrical power through rotation of the turbine 124. Each of the turbines 124 may be coupled to one of the plurality of downhole flow control valves 129. Referring to FIG. 3, the electrical power source may also include one or more batteries 126. The batteries 126 may be rechargeable batteries. Each of turbines 124 may be electrically coupled to the motor 190, the batteries 126 electrically coupled to the motor 190, or both. The system 300 may further include an electrical line 128 electrically coupling the plurality of turbines 124 to each other and to the motor 190, the batteries 126, or both.

Referring to FIG. 2, the system 300 may include a plurality of packers 122. One of the plurality of packers 122 may be disposed between each of the plurality of downhole flow control valves 120. Referring to FIG. 1, the packers 122 disposed between each of the plurality of downhole flow control valves 120 may operate to fluidly isolate each of the downhole flow control valves 120 from the other downhole flow control valves 120 so that fluid flow from any one lateral branch 112 to any uphole or downhole portions of the wellbore 100 can only be accomplished by actuating the downhole flow control valve 120 installed at that lateral branch into the open position. The system 300 may additionally include a packer 122 installed uphole of the system 300, such as uphole of the uppermost downhole flow control valve 120. The system 300 may also optionally include a packer 122 disposed downhole of the bottom most downhole flow control valve 120 to isolate the bottom most portions of the central bore 110 from the lateral branches 112. Any commercially available packer device may be utilized for one or more of the packers 122.

Referring again to FIG. 3, the motor 190 may be electrically coupled to the electrical power source, such as the plurality of turbines 124, the batteries 126, or both. The motor 190 may be disposed downhole relative to the plurality of downhole flow control valves 120 and plurality of turbines 124. The motor 190 may be operatively coupled to the drive gear 182 of each of the plurality of downhole flow control valves 120. The motor 190 may be operatively coupled to each of the drive gears 182 by one or more linkages 191, such as one or more mechanical, electrical, or electromechanical linkages. The one or more linkages 191 may include one or more drive shaft assemblies 240, 240' operatively coupling the motor 190 to each of the downhole flow control valves 120, 120', as previously discussed in relation to FIGS. 9 and 10. The motor 190 may be operable to rotate the drive gear 182 of each downhole flow control valve 120 to move the inner sleeve 160 between the open position and the closed position. The motor 190 may be operable to rotate the drive gear 182 of each downhole flow control valve 120 independently of any of the other downhole flow control valves 120.

Referring again to FIG. 3, the system 300 may include a motor controller 192 operatively coupled to the motor 190. The motor controller 192 may include at least one motor controller processor 194, at least one motor controller memory module 196, and computer readable and executable instructions 197, which may be stored on the at least one motor controller memory module 196. The motor controller 192 may further include a motor controller network interface device 198 communicatively coupled to the motor controller processor 194, motor controller memory module 196, or both, through wired or wireless communication methods. The motor controller network interface device 198 may be operable to send and receive signals from one or more system components. The motor controller network interface device 198 may be operable to receive one or more wireless signals from the system controller 301 disposed at the surface 102 of the wellbore 112. The one or more wireless signals received from the system controller 301 may include one or more valve control signals, which may be indicative of the positions of one or more of the downhole flow control valves 120. The motor controller network interface device 198 may be operable to receive the wireless signals from the system controller 301 through the wellbore casing 114 (FIG. 1) of the wellbore 100. In embodiments, the wireless signals may be transferred through the wellbore casing 114 between the system controller 301 and the motor controller 192 through vibrations, sound waves, or other signals passed through the material of the wellbore casing 114.

The motor controller network interface device 198 may be communicatively coupled to the motor 190 through wired or wireless communications. The motor controller network interface device 198 may be operable to transmit one or more motor control signals from the motor controller 192 to the motor 190. The motor control signals may cause the motor 190 to operate to transition one or more downhole flow control valves 120 from the open position to the closed position or between the closed position and the open position.

The computer readable and executable instructions 197, when executed by the at least one motor controller processor 194, may cause the motor controller 192 to automatically receive one or more valve control signals from a system controller 301 (FIG. 1). Each of the one or more valve control signals may be indicative of a position of one or more of the downhole flow control valves 120. The computer readable and executable instructions 197, when executed by the at least one motor controller processor 194, may cause the motor controller 192 to automatically operate the motor 190 to transition one or more of the downhole flow control valves 120 to the open position or the closed position based on the one or more valve control signals. The motor 190 may transition each downhole flow control valves 120 independently of the other downhole flow control valves 120. The computer readable and executable instructions 197, when executed by the at least one motor controller processor 194, may cause the motor controller 192 to automatically determine one or more motor control signals based on the valve control signals received from the system controller 301 and transmit the one or more motor control signals to the motor, where the one or more motor control signals may cause the motor 190 to transition one or more downhole flow control valves 120 from the open position to the closed position or between the closed position and the open position.

Referring again to FIG. 3, as previously discussed, each of the downhole flow control valves 120 of the system 300 may include one or a plurality of sensors 230. The sensors 230 may be operable to measure one or a plurality of properties of the fluids from the lateral branch 112 contacting the downhole flow control valve 120. The sensors 230 may include one or more of a production pressure sensor, a fluid density sensor, a viscosity sensor, a temperature sensor, or combinations of these. Other types of sensors measuring other properties of the fluid in the lateral branch 112 are contemplated. In embodiments, each of the sensors 230 may be electrically coupled to the electrical power source (turbines 124 or batteries 126). In other embodiments, each of the sensors 230 may include an independent power source, such as a sensor battery.

Each of the sensors 230 may include a sensor network interface device (not shown) that may be operable to wirelessly transmit one or more property signals to one or more other components of the system 300, such as but not limited to the system controller 301, the motor controller 192, or both. The property signals may be indicative of one or more properties of the fluid in the lateral branch 112 (FIG. 1) contacting the downhole flow control valve 120. In embodiments, the sensor network interface devices may be operable to wirelessly transmit the property signals through the wellbore casing 114 (FIG. 1) of the wellbore 100 from the sensors 230 to the system controller 301 located at the surface 102 of the wellbore 100. As discussed further in the present disclosure, the property signals from the sensors 230 may be used by the system controller 301 to determine the position of each of the downhole flow control valves 120 based on the properties of the fluids in the lateral branches 112.

Figure 12:
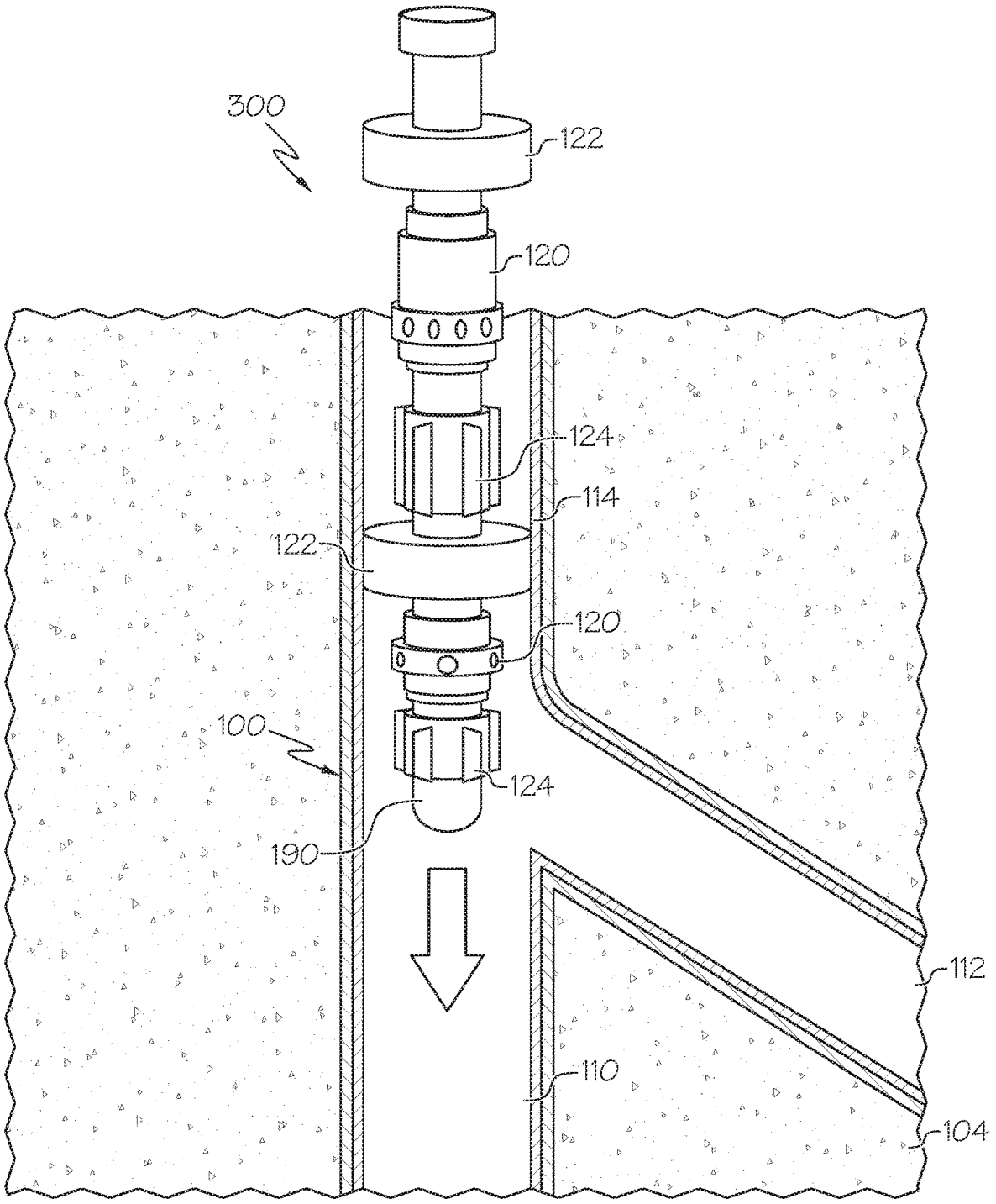
FIG. 12 schematically depicts installation of the system of FIG. 1 in a wellbore having at least one lateral branch, according to one or more embodiments shown and described in this disclosure.
Figure 13:
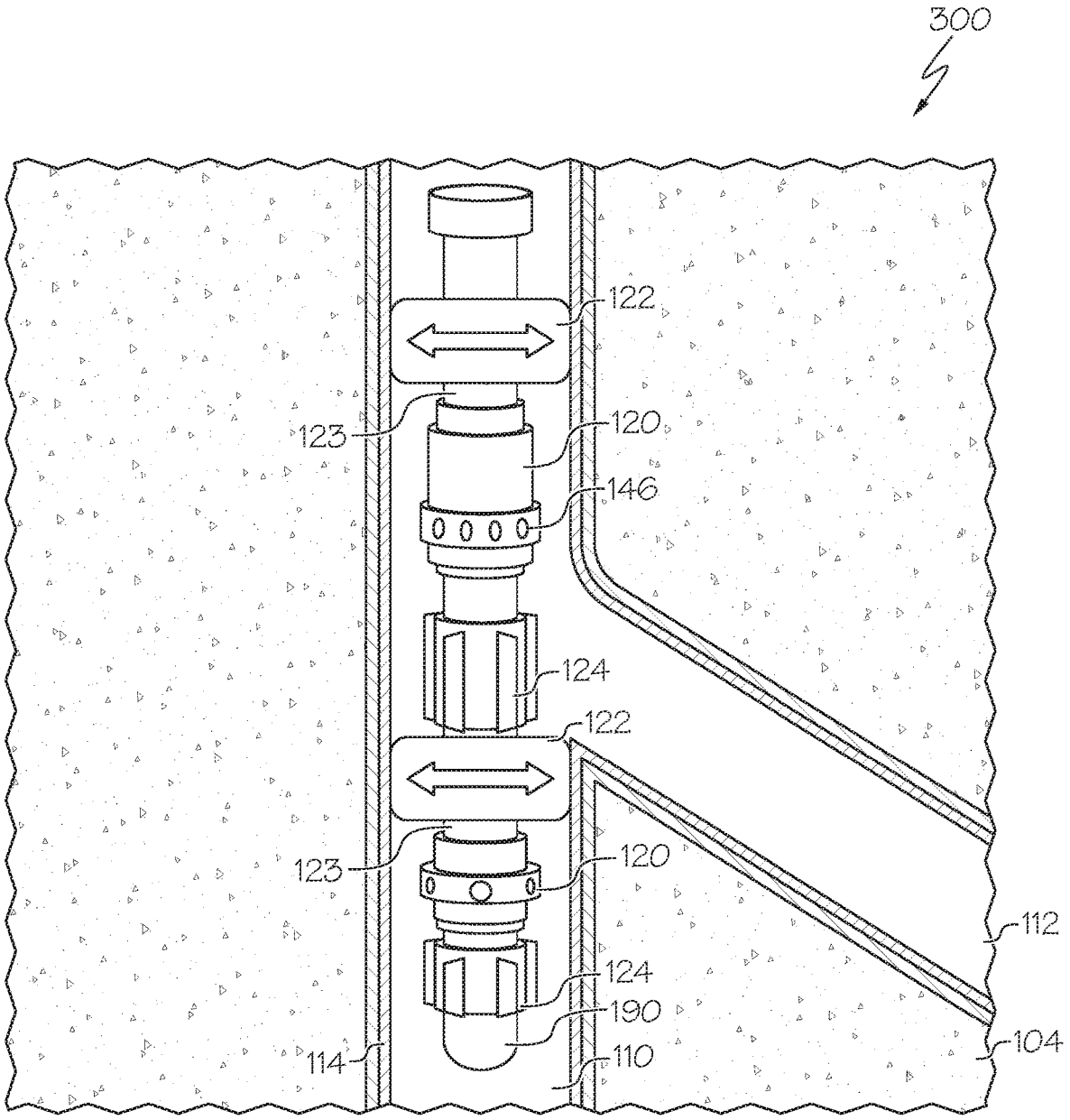
FIG. 13 schematically depicts the system of FIG. 12 installed in the wellbore, according to one or more embodiments shown and described in this disclosure.

Referring now to FIG. 12, the system 300 may be installed in the wellbore 100 by inserting an assembly comprising the plurality of downhole flow control valves 120, plurality of turbines 124, plurality of packers 122, sensors 230, motor 190, and batteries 126 into the central bore 110 (e.g., motherbore) of the wellbore 100. The system 300 may include one or more spacers 123 disposed between components to adjust the downhole spacing of the various components to align each downhole flow control valve 120 relative to the corresponding lateral branch 112. Referring to FIG. 13, the insertion of the system 300 into the wellbore 100 may be accomplished by methods known in the art. The system 300 may be positioned in the central bore 110 so that one or more of the downhole flow control valves 120 are positioned at the junction between a lateral branch 112 and the central bore 110. When installed, the openings 146 of each of the downhole flow control valves 120 may be in fluid communication with the fluids in one of the lateral branches 112, and the turbines 124 may be positioned to contact the flow of fluids passing from the lateral branch 112 through the openings 146 in the downhole flow control valve 120 when the downhole flow control valve 120 is in the open position.

In embodiments, the system 300 may include one downhole flow control valve 120 and turbine 124 disposed in a bottom-most position below the bottom-most packer 122 to control the flow of fluids produced from the central bore 110 to the surface 102. Once installed in the proper position, the packers 122 may be expanded to fluidly isolate each of the downhole flow control valves 120 from each other so that fluid communication between each lateral branch 112 and the central bore 110 is controlled by one of the downhole flow control valves 120.

Figure 14:
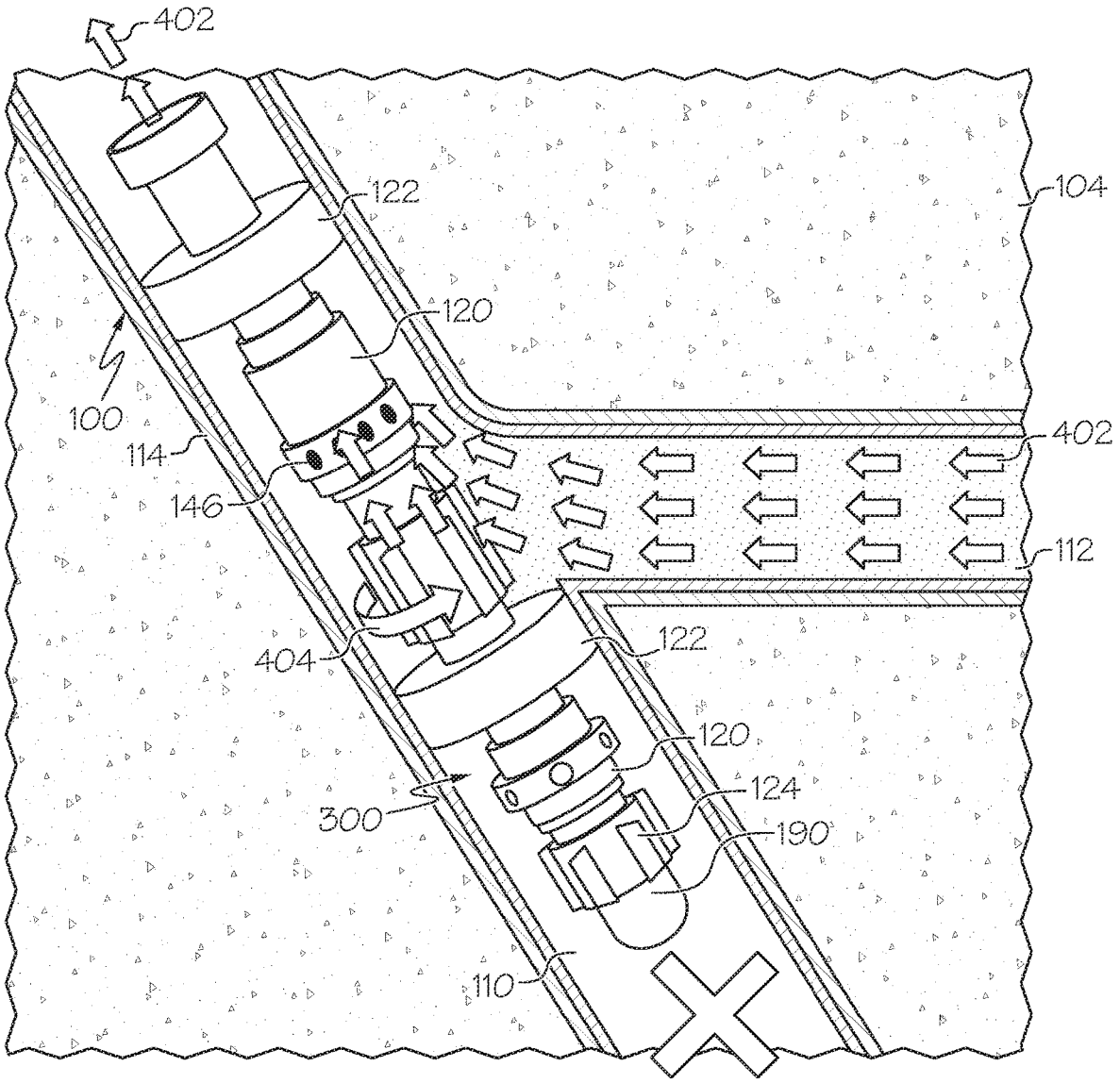
FIG. 14 schematically depicts the system of FIG. 13 in a first configuration to allow fluid flow from the lateral branch to the surface and disallow fluid flow from the central bore, according to one or more embodiments shown and described in this disclosure.
Figure 15:
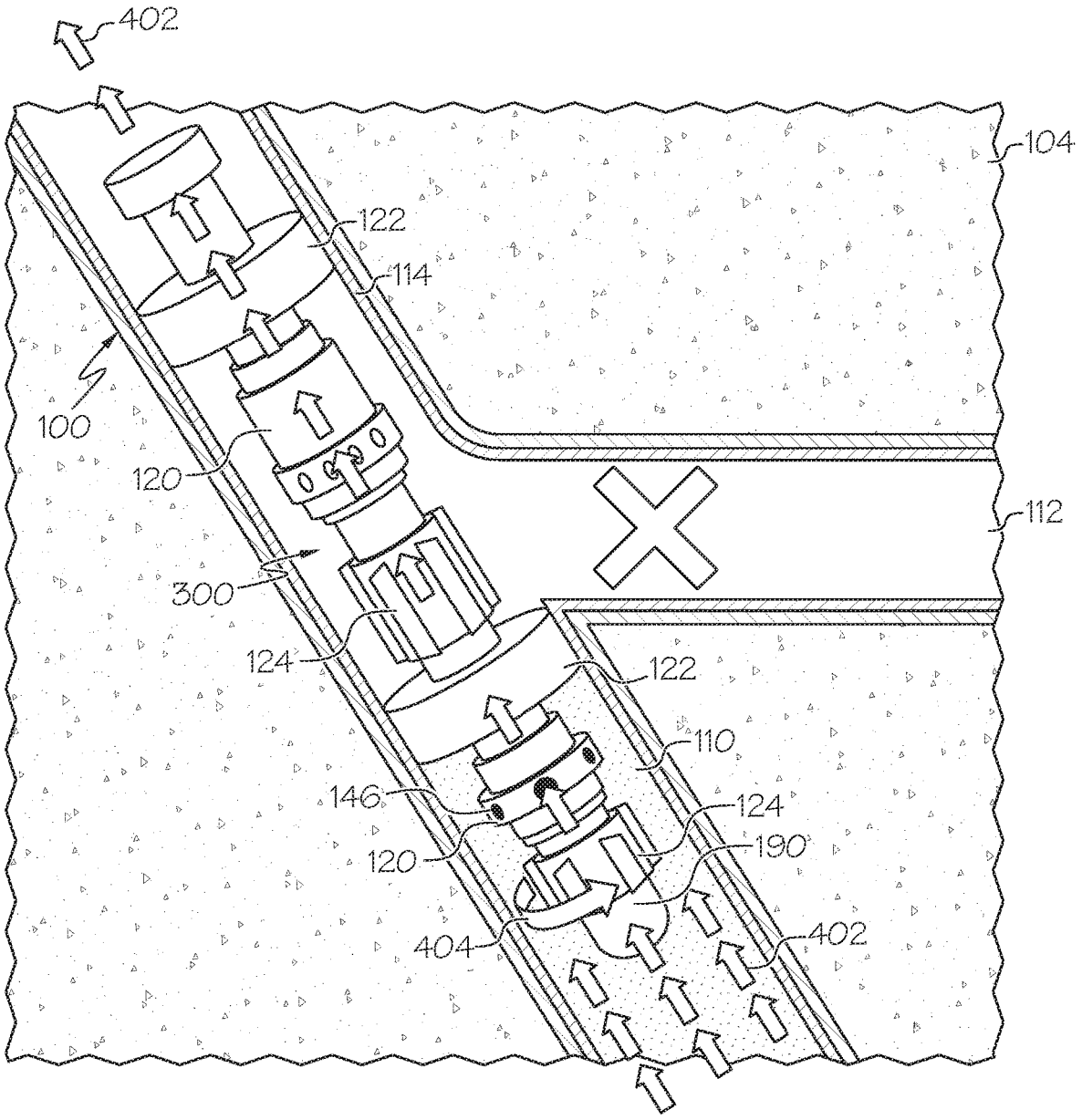
FIG. 15 schematically depicts the system of FIG. 13 in a second configuration to prevent fluid flow from the lateral branch and allow fluid flow from the central bore to the surface, according to one or more embodiments shown and described in this disclosure.

During operation of the system 300, one or more of the downhole flow control valves 120 may be transitioned to the open position and one or more other downhole flow control valves 120 may be transitioned to the closed position. Whether any particular downhole flow control valve 120 is transitioned to the open or closed position may be determined from one or more fluid properties of the fluid in the lateral branch 112 based on measurements made by the one or more sensors 230 (FIG. 3). Referring now to FIG. 14, the system 300 is depicted in which one of the downhole flow control valves 120 disposed at a lateral branch 112 of the wellbore 100 is in the open position while the bottom-most downhole flow control valve 120 is in the closed position. In FIGS. 14 and 15, the openings of the downhole flow control valves 120 are colored in black to indicate the open position, while the openings that are not colored in black indicates the closed position. In FIG. 14, the open position of the downhole flow control valve 120 disposed at the lateral branch 112 may allow fluid from the lateral branch 112 to flow from the lateral branch 112 through the openings 146 in the downhole flow control valve 120 and into the fluid flow path 166. The fluid flow from the lateral branch 112 through the openings 146 in the downhole flow control valve 120 and into the central bore 110 of the wellbore 100 is indicated in FIG. 14 by the straight arrows 402. The fluid flowing from the lateral branch 112 through the openings 146 in the downhole fluid flow control valve 120 may contact the turbine 124 at the junction of the lateral branch 112 and the central bore 110. Contact of the flowing fluid with the turbine 124 may turn the turbine 124 to generate electrical power, as indicated by the curved arrow 404 in FIG. 14.

As shown in FIG. 14, the bottom-most downhole flow control valve 120 may be positioned to control fluid flow produced by the central bore 110. The bottom-most downhole flow control valve 120 is depicted in FIG. 14 as being in the closed position in which the openings 146 are blocked by the inner sleeve 160 of the downhole flow control valve 120. In the closed position, the bottom-most downhole flow control valve 120 in FIG. 14 may restrict or prevent flow of fluids produced from the central bore 110 in the uphole direction through the system 300, as indicated by the X in FIG. 14. The lack of fluid flow in the region of the bottom-most downhole flow control valve 120 in FIG. 14 may result in the turbine 124 coupled to the bottom most downhole flow control valve 120 not being turned and not generating electrical power. However, as previously discussed, each of the turbines 124 may be electrically coupled together and to the motor 190, so that when one turbine 124 is idle due to the associated downhole flow control valve 120 being closed, the other turbines 124 coupled to downhole flow control valves 120 in the open position may still be operable to generate electrical power to power the motor 190.

Referring now to FIG. 15, the system 300 is shown in which the downhole flow control valve 120 disposed at the junction of the lateral branch 112 and the central bore 110 is in the closed position to prevent flow from the lateral branch 112 into the downhole flow control valve 120 and into the central bore 110. In FIG. 15, the bottom-most downhole flow control valve 120 is depicted in the open position to allow fluids produced by the central bore 110 to pass uphole through the fluid flow paths 166 through the center of the downhole flow control valves 120 and turbines 124, as indicated by the straight arrows 402 in FIG. 15. In FIG. 15, the fluid flow of the fluids produced by the central bore 110 contact the turbine 124 attached to the bottom-most downhole flow control valve 120 and turn the turbine 124 to generate electrical power for operation of the motor 190, as indicated by the curved arrow 404 in FIG. 15.

Referring now to FIG. 3, as previously discussed, the plurality of turbines 124 may be electrically coupled to each other and to the motor 190, the batteries 126, or both. When the plurality of turbines 124 are electrically coupled together and to the motor 190, the batteries 126, or both, electrical power may be generated to run the motor 190 by the turbines 124 coupled to downhole flow control valves 120 that are in the open position, even when one or more of the downhole flow control valves 120 are in the closed positon. Thus, as long as one downhole flow control valve 120 is in the open position such that fluid flowing from the lateral branch 112 can rotate the turbine 124 to generate power for operation of the motor 190. When none of the downhole flow control valves 120 is in the open positon, the batteries 126 may provide electrical power for operation of the motor. Thus, the downhole flow control valves 120 may be independently powered so that they do not rely on electrical power or hydraulic power from the surface of the wellbore 100. In embodiments, the downhole assembly comprising the downhole flow control valves 120, packers 122, sensors 230, motor 190, motor controller 192, and turbines 124 may be electrically isolated from the surface 102 when installed downhole.

Referring again to FIG. 1, the system 300 may further include a system controller 301, which may be disposed at the surface 102 of the wellbore 100. The system controller 301 may include at least one system processor 302, at least one system memory module 304, and computer readable and executable instructions stored on the at least one system memory module 304. The system controller 301 may further include a system network interface device 306 communicatively coupled to the system processor(s) 302, system memory module(s) 304, or both, through wired or wireless communication methods. The system network interface device 306 may be operable to send and receive signals from one or more system components wirelessly. Thus, the system controller 301 may be electrically isolated from the downhole components of the system 300. In other words, no control wiring or power lines extend between the system controller 301 at the surface 102 and the downhole components of the system 300 installed in the wellbore 100. The downhole components of the system 300 refer collectively to the downhole flow control valves 120, sensors 230, motor 190, motor controller 192, turbines 124, packers 122, and other downhole components that are installed downhole in the wellbore 100.

The system network interface device 306 may be operable to receive one or more wireless signals from the sensors 230 coupled to the downhole flow control valves 120, the motor controller 192, or both. The one or more wireless signals received from the sensors 230 may include one or more fluid property signals, which may be indicative of one or more properties of fluids in one or more of the lateral branches 112 or fluids produced by the central bore 110. The system network interface device 306 may be operable to receive the wireless signals from the downhole system components through the wellbore casing 114 of the wellbore 100. In embodiments, the wireless signals may be transferred through the wellbore casing 114 between the system controller 301 and the downhole components through vibrations, sound waves, or other signals passed through the material of the wellbore casing 114. In embodiments, no wired communication extends from the system controller 301 at the surface 102 to the downhole system components, such as the downhole flow control valves 120, turbines 124, sensors 230, motor 190, motor controller 190, or other components.

The computer readable and executable instructions of the system controller 301, when executed by the at least one system processor 302, may cause the system controller 301 to automatically receive at least one property signal from at least one sensor 230 coupled to one of the plurality of downhole flow control valves 120, where the at least one property signal may be indicative of at least one property of a fluid contacting the one of the plurality of downhole flow control valves 120. The computer readable and executable instructions of the system controller 301, when executed by the at least one system processor 302, may cause the system controller 301 to automatically determine a position of the one of the plurality of downhole flow control valves 120 based on the property signal received from the sensors 230 and transmit a valve control signal indicative of a position of the one of the plurality of downhole flow control valves 120 to the motor controller 192 operatively coupled to the motor 190.

The system controller 301 may include an algorithm stored on the one or more system memory modules 304. The algorithm may determine whether to open one or more of the downhole flow control valves 120 based on the fluid properties of the fluids in one or more of the lateral branches 112, the central bore 110, or combinations of these. The fluid properties input into the algorithm may include the production pressure of the fluid, the fluid temperature, the density of the fluid, the viscosity of the fluid, or other property of the fluid. The algorithm may depend on the characteristics of the wellbore 110 into which the system 300 is installed, the characteristics of the hydrocarbon bearing subterranean formations 104 into which the wellbore 100 extends, and the overall strategy for recovering the hydrocarbons from the hydrocarbon bearing subterranean formation 104, including whether and which enhanced oil recovery methods are employed to increase yield from the hydrocarbon bearing subterranean formations.

The system controller 301 and motor controller 192 described in the present disclosure are two contemplated examples of suitable computing devices but do not suggest any limitation on the scope of any embodiments presented. Nothing illustrated or described with respect to the controllers (system controller 301, motor controller 190) should be interpreted as being required or as creating any type of dependency with respect to any element or plurality of elements of the present disclosure. It is understood that various methods and control schemes described in the present disclosure may be implemented using one or more analog control devices in addition to or as an alternative to the controllers (system controller 301, motor controller 190). Any of the controllers may include, but are not limited to, an industrial controller, desktop computer, laptop computer, server, client computer, tablet, smartphone, or any other type of device that can send data, receive data, store data, and perform one or more calculations. In embodiments, each of the controllers may include at least one processor (system processor 302, motor controller processor 194) and at least one memory module (system memory module 304, motor controller memory module 196, which may include non-volatile memory and/or volatile memory). Any of the controllers can include a display and may be communicatively coupled to one or more output devices, such as one or more components of the system 300. Any of the controllers may further include one or more input devices which can include, by way of example, any type of mouse, keyboard, keypad, push button array, switches, disk or media drive, memory stick (thumb drive), memory card, pen, touch-input device, biometric scanner, audio input device, sensors, or combinations of these. In embodiments, the input devices may include one or a plurality of the sensors 230 disclosed in the present disclosure.

Any of the memory modules described in the present disclosure may include a non-volatile memory (ROM, flash memory, etc.), volatile memory (RAM, etc.), or a combination of these. The controllers of the present disclosure can include a network interface device, which can facilitate communication with the input devices and output devices or over a network via wires, via a wide area network, via a local area network, via a personal area network, via a cellular network, via a satellite network, or a combination of these. Suitable local area networks may include wired Ethernet and/or wireless technologies such as, for example, wireless fidelity (Wi-Fi). Suitable personal area networks may include wireless technologies such as, for example, IrDA, Bluetooth, Wireless USB, Z-Wave, ZigBee, other near field communication protocols, or combinations of these. Suitable personal area networks may similarly include wired computer buses such as, for example, USB and FireWire. Suitable cellular networks include, but are not limited to, technologies such as LTE, WiMAX, UMTS, CDMA, and GSM. Network interface 173 can be communicatively coupled to any device capable of transmitting data, receiving data, or both via a network. The network interface devices of the present disclosure may also be capable of communicating wirelessly with one or more system components by transmitting vibrations, sound waves, or other signals through the material comprising the casing of the wellbore 100.

The hardware of the network interface devices can include a communication transceiver for sending, receiving, or both, any wired or wireless communication. Various components, such as the sensors 230, motor controller 192, system controller 301, or combinations of these may utilize one or more network interface devices to communicate with the processors through the network. For example, the hardware of the network interface devises may include an antenna, a modem, LAN port, Wi-Fi card, WiMax card, mobile communications hardware, near-field communication hardware, satellite communication hardware and/or any wired or wireless hardware for communicating with other networks and/or devices.

The one or more memory modules described in the present disclosure may include one or a plurality of computer readable storage mediums, each of which may be either a computer readable storage medium or a computer readable signal medium. A computer readable storage medium may reside, for example, within an input device, non-volatile memory, volatile memory, or any combination thereof. A computer readable storage medium can include tangible media that is able to store instructions associated with, or used by, a device or system. A computer readable storage medium includes, by way of non-limiting examples: RAM, ROM, cache, fiber optics, EPROM/Flash memory, CD/DVD/BD-ROM, hard disk drives, solid-state storage, optical or magnetic storage devices, diskettes, electrical connections having a wire, or any combination thereof. A computer readable storage medium may also include, for example, a system or device that is of a magnetic, optical, semiconductor, or electronic type. Computer readable storage media and computer readable signal media are mutually exclusive.

A computer readable signal medium can include any type of computer readable medium that is not a computer readable storage medium and may include, for example, propagated signals taking any number of forms such as optical, electromagnetic, or a combination thereof. A computer readable signal medium may include propagated data signals containing computer readable code, for example, within a carrier wave.

The depictions of the controllers (system controller 301, motor controller 192) in the drawings are simplified representations of the controllers. Many components of the computing controllers have been omitted for purposes of clarity. Assembling various hardware components into a functioning controller of computing device is considered to be part of the ordinary skill in the art. The various hardware components, in particular the hardware components for the motor controller 190 and/or sensors 230, may be suitable for operation under downhole conditions, such as at downhole temperature and pressure conditions.

It is noted that recitations herein of a component of the present disclosure being "configured", "structured" or "programmed" in a particular way, to embody a particular property, or to function in a particular manner, are structural recitations, as opposed to recitations of intended use. More specifically, the references herein to the manner in which a component is "configured", "structured" or "programmed" denotes an existing physical condition of the component and, as such, is to be taken as a definite recitation of the structural characteristics of the component.

Referring again to FIGS. 14 and 15, methods for controlling flow from at least one lateral branch 112 of a wellbore 100 will now be described. The methods may include positioning at least one of the downhole flow control valves 120 at an intersection of the at least one lateral branch 112 and the central bore 110 (motherbore) of the wellbore 100. The downhole flow control valve 120 may include a valve assembly 130, a driven gear 180, a drive gear 182, and a motor 190. The valve assembly 130 may include an outer sleeve 140 and an inner sleeve 160. The outer sleeve 140 of the valve assembly 130 may define one or more openings 146, and may have an inner surface 144 and a fixed guide 150 coupled to the inner surface 144. The inner sleeve 160 of the valve assembly 130 may be disposed within the outer sleeve 140 and may include an outer surface 162 and an inner surface 164. The inner surface 164 of the inner sleeve 160 and the inner surface 144 of the outer sleeve 140 may define a fluid flow path 166 extending axially through the downhole flow control valve 120. The outer surface 162 of the inner sleeve 160 may include an axially abutting surface 170 defining a stair-stepped pathway 172 around at least a portion of the outer surface 162 of the inner sleeve 160. The fixed guide 150 of the outer sleeve 140 may abut against the axially abutting surface 170 of the outer surface 162 of the inner sleeve 160. The motor 190 may be operatively coupled to the drive gear 182 to rotate the drive gear 182, and the drive gear 182 may be engaged with the driven gear 180. The driven gear 180 may be rigidly coupled to one end of the inner sleeve 160 of the valve assembly 130 such that rotation of the drive gear 182 rotates the driven gear 180 and the inner sleeve 160 relative to the outer sleeve 140. The abutment of the fixed guide 150 of the outer sleeve 140 against the axially abutting surface 170 of the inner sleeve 160 may cause the inner sleeve 160 to translate in an axial direction between an open position and a closed position relative to the outer sleeve 140 when the inner sleeve 160 is rotated through operation of the motor 190, drive gear 182, and driven gear 180. The downhole flow control valves 120 may have any of the other features or characteristics previously described in this disclosure for the downhole flow control valves 120.

The methods may further include determining whether to allow fluid flow from the at least one lateral branch 112 and transitioning the at least one downhole flow control valve 120 to the open position or the closed position based on the determination. Determining whether to allow fluid flow from a particular lateral branch 112 or from the central bore 110 may be based on one or more fluid properties of the fluid in the lateral branch 112 or central bore 110. The methods of the present disclosure may include measuring at least one property of the fluid in the at least one lateral branch 112 with at least one sensor 230 (FIG. 3) coupled to the at least one downhole flow control valve 120, determining a position of the at least one downhole flow control valve 120 based on the measured property, and transitioning the at least one downhole flow control valve 120 to the open position or the closed position based on the determination. The measured property may be one or more of a production pressure of the fluid, a fluid density, a fluid viscosity, a temperature of the fluid, or combinations of these.

Referring again to FIG. 1, in embodiments, the wellbore 100 may include a plurality of lateral branches 112, and the methods may include positioning a plurality of downhole flow control valves 120 in the wellbore 100, where each of the plurality of downhole flow control valves 120 is disposed at an intersection of the central bore 110 with one of the plurality of lateral branches 112. The methods may further include measuring at least one property of a fluid in each of the plurality of lateral branches 112 with one or more sensors 230 coupled to each of the plurality of downhole flow control valves 120, determining a position of each of the plurality of downhole flow control valves 120 based on the measured properties of the fluids in each of the plurality of lateral branches 112, and transitioning one or more of the plurality of downhole flow control valves 120 to the open position or the closed position based on the determination. In embodiments, at least one of the downhole flow control valves 120 may be disposed downhole of the deepest lateral branch 112 and may be operable to control flow of fluids produced by the central bore 110.

It is noted that one or more of the following claims utilize the terms "where," "wherein," or "in which" as transitional phrases. For the purposes of defining the present technology, it is noted that these terms are introduced in the claims as an open-ended transitional phrase that are used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A downhole flow control valve comprising a valve assembly, a drive gear, a driven gear, and a motor, wherein:

the valve assembly comprises an outer sleeve and an inner sleeve;

the outer sleeve of the valve assembly comprises one or more openings, an inner surface, and a fixed guide coupled to the inner surface of the outer sleeve;

the inner sleeve of the valve assembly is disposed within the outer sleeve of the valve assembly;

the inner sleeve of the valve assembly comprises an inner surface and an outer surface;

the inner surface of the inner sleeve and portions of the inner surface of the outer sleeve define a fluid flow path extending axially through the downhole flow control valve;

the outer surface of the inner sleeve of the valve assembly comprises an axially abutting surface defining a stair-stepped pathway around at least a portion of the outer surface of the inner sleeve;

the fixed guide of the outer sleeve abuts against the axially abutting surface of the outer surface of the inner sleeve;

the motor is operatively coupled to the drive gear to rotate the drive gear;

the drive gear is engaged with the driven gear and the driven gear is rigidly coupled to one end of the inner sleeve of the valve assembly such that rotation of the drive gear rotates the driven gear and the inner sleeve relative to the outer sleeve; and the abutment of the fixed guide of the outer sleeve against the axially abutting surface of the inner sleeve causes the inner sleeve to translate in an axial direction between an open position and a closed position relative to the outer sleeve when the inner sleeve is rotated through operation of the motor, drive gear, and driven gear.

2. The downhole flow control valve of claim 1, where rotation of the inner sleeve in a first rotational direction causes translation of the inner sleeve axially into the closed position where the inner sleeve blocks the one or more openings in the outer sleeve.

3. The downhole flow control valve of claim 2, where rotation of the inner sleeve in a second rotational direction opposite the first rotational direction or further rotation of the inner sleeve in the first direction causes translation of the inner sleeve axially into the open position in which the openings in the outer sleeve are in fluid communication with the fluid flow path defined by the inner surface of the inner sleeve.

4. The downhole flow control valve of claim 1, where:

the outer surface of the inner sleeve comprises at least one rail protruding radially outward from the outer surface; and the at least one rail comprising the axially abutting surface.

5. The downhole flow control valve of claim 1, where:

the fixed guide comprises a roller coupled to the outer sleeve by a pin; and the roller rotates about the pin relative to the outer sleeve.

6. The downhole flow control valve of claim 1, further comprising a turbine coupled to the outer sleeve and rotatable relative to the outer sleeve, where:

the turbine is electrically coupled to the motor; and the turbine is operable to produce at least a portion of the electrical power for operating the motor through rotation of the turbine.

7. The downhole flow control valve of claim 1, further comprising one or more batteries, where:

the one or more batteries are electrically coupled to the motor, and the one or more batteries are operable to provide electrical power for operating the motor.

8. The downhole flow control valve of claim 7, where the one or more batteries are electrically coupled to a turbine operable to generate electrical power to recharge the battery.

9. The downhole flow control valve of claim 1, further comprising at least one sensor operable to measure one or more properties of a fluid in contact with the downhole flow control valve, where the at least one sensor comprises one or more of a production pressure sensor, a fluid density sensor, a viscosity sensor, a temperature sensor, or combinations of these.

10. A system for controlling fluid flow in one or more lateral branches of a multilateral wellbore, the system comprising a plurality of downhole flow control valves, a plurality of packers, a motor, and an electrical power source, wherein:

each downhole flow control valve comprises an outer sleeve, an inner sleeve, a driven gear, and a drive gear; wherein the outer sleeve of each downhole flow control valve comprises one or more openings and a fixed guide coupled to an inner surface of the outer sleeve;

the inner sleeve is disposed within the outer sleeve for each downhole flow control valve;

the inner surfaces of the inner sleeve and the outer sleeve of each downhole flow control valve define a fluid flow path extending axially through the downhole flow control valve;

the outer surface of the inner sleeve of each downhole flow control valve comprises an axially abutting surface defining a stair-stepped pathway on at least a portion of the outer surface of the inner sleeve;

the fixed guide of the outer sleeve abuts against the axially abutting surface of the outer surface of the inner sleeve;

the driven gear is rigidly coupled to one end of the inner sleeve;

the drive gear is engaged with the driven gear to rotate the driven gear and the inner sleeve relative to the outer sleeve; and abutment of the fixed guide of the outer sleeve against the axially abutting surface of the inner sleeve causes the inner sleeve to translate in an axial direction between an open position and a closed position relative to the outer sleeve when the inner sleeve is rotated;

one of the plurality of packers is disposed between each of the plurality of downhole flow control valves;

the motor is operatively coupled to the drive gear of each downhole flow control valve;

the motor is operable to rotate the drive gear of each downhole flow control valve to move the inner sleeve between the open position and the closed position; and the electrical power source is disposed downhole and is electrically coupled to the motor to provide electrical power to the motor.

11. The system of claim 10, where the electrical power source comprises one or more batteries.

12. The system of claim 10, where the electrical power source comprises a plurality of turbines operable to produce electrical power through rotation of the turbine, where:

each of the plurality of turbines is coupled to one of the plurality of downhole flow control valves; and each of the plurality of turbines is electrically coupled to the motor, a battery that is electrically coupled to the motor, or both.

13. The system of claim 10, where the plurality of downhole flow control valves, the motor, and the electrical power source are electrically isolated from a surface of a wellbore when the plurality of downhole flow control valves are installed in the wellbore.

14. The system of claim 10, where one or more of the plurality of downhole flow control valves comprise at least one sensor operable to measure at least one property of a fluid contacting the downhole flow control valve, where the at least one sensor comprises one or more of a production pressure sensor, a fluid density sensor, a viscosity sensor, a temperature sensor, or combinations of these.

15. The system of claim 14, where the at least one sensor comprises at least one sensor network interface device operable to wirelessly transmit one or more property signals indicative of one or more properties of the fluid contacting the downhole flow control valve with a system controller disposed at a surface of a wellbore.

16. The system of claim 10, further comprising a motor controller comprising at least one motor processor, at least one motor memory module, and computer readable and executable instructions that, when executed by the at least one motor processor, cause the motor controller to automatically:

receive one or more valve control signals from a system controller, where each of the one or more valve control signals is indicative of a position of one or more of the plurality of downhole flow control valves; and operate the motor to transition one or more of the plurality of downhole flow control valves to the open position or the closed position based on the one or more valve control signals.

17. The system of claim 16, where the motor controller comprises a motor network interface device operable to receive one or more wireless signals from the system controller disposed at a surface of a wellbore, the one or more wireless signals comprising the one or more valve control signals.

18. The system of claim 10, further comprising a system controller disposed at a surface of a wellbore in which the plurality of downhole flow control valves are installed, the system controller comprising at least one system processor, at least one system memory module, and computer readable and executable instructions which, when executed by the at least one system processor, causes the system controller to automatically:

receive at least one property signal from at least one sensor coupled to one of the plurality of downhole flow control valves, where the at least one property signal is indicative of at least one property of a fluid contacting the one of the plurality of downhole flow control valves;

determine a position of the one of the plurality of downhole flow control valves based on the property signal; and transmit a valve control signal indicative of a position of the one of the plurality of downhole flow control valves to a motor controller operatively coupled to the motor.

19. A method for controlling flow from at least one lateral branch of a wellbore, the method comprising:

positioning at least one downhole flow control valve at an intersection of the at least one lateral branch and a central bore of the wellbore, the at least one downhole flow control valve comprising a valve assembly, a drive gear, a driven gear, and a motor, where:

the valve assembly comprises an outer sleeve and an inner sleeve;

the outer sleeve of the valve assembly comprises one or more openings, an inner surface, and a fixed guide coupled to the inner surface of the outer sleeve;

the inner sleeve of the valve assembly is disposed within the outer sleeve of the valve assembly;

the inner sleeve of the valve assembly comprises an inner surface and an outer surface;

the inner surface of the inner sleeve and the inner surface of the outer sleeve define a fluid flow path extending axially through the downhole flow control valve;

the outer surface of the inner sleeve of the valve assembly comprises an axially abutting surface defining a stair-stepped pathway around at least a portion of the outer surface of the inner sleeve;

the fixed guide of the outer sleeve abuts against the axially abutting surface of the outer surface of the inner sleeve;

the motor is operatively coupled to the drive gear to rotate the drive gear;

the drive gear is engaged with the driven gear and the driven gear is rigidly coupled to one end of the inner sleeve of the valve assembly such that rotation of the drive gear rotates the driven gear and the inner sleeve relative to the outer sleeve;

the abutment of the fixed guide of the outer sleeve against the axially abutting surface of the inner sleeve causes the inner sleeve to translate in an axial direction between an open position and a closed position relative to the outer sleeve when the inner sleeve is rotated through operation of the motor, drive gear, and driven gear;

determining whether to allow fluid flow from the at least one lateral branch; and transitioning the at least one downhole flow control valve to the open position or the closed position based on the determination.

20. The method of claim 19, further comprising:

measuring at least one property of a fluid in the at least one lateral branch with at least one sensor coupled to the at least one downhole flow control valve;

determining a position of the at least one downhole flow control valve based on the measured property; and transitioning the at least one downhole flow control valve to the open position or the closed position based on the determination.

* * * * *